US010907266B2

(12) United States Patent
Wang et al.

(10) Patent No.: US 10,907,266 B2
(45) Date of Patent: Feb. 2, 2021

(54) METHOD AND APPARATUS FOR UNIFORMLY METALLIZATION ON SUBSTRATE

(71) Applicant: ACM Research (Shanghai) Inc., Shanghai (CN)

(72) Inventors: Hui Wang, Shanghai (CN); Fuping Chen, Shanghai (CN); Xi Wang, Shanghai (CN)

(73) Assignee: ACM Research (Shanghai) Inc., Shanghai (CN)

( * ) Notice: Subject to any disclaimer, the term of this patent is extended or adjusted under 35 U.S.C. 154(b) by 227 days.

(21) Appl. No.: 16/142,789

(22) Filed: Sep. 26, 2018

(65) Prior Publication Data

US 2019/0024253 A1 Jan. 24, 2019

Related U.S. Application Data

(62) Division of application No. 14/784,042, filed as application No. PCT/CN2013/074527 on Apr. 22, 2013, now Pat. No. 10,113,244.

(51) Int. Cl.

| | |
|---|---|
| ***C25D 5/20*** | (2006.01) |
| ***C25D 5/18*** | (2006.01) |
| ***C25D 17/06*** | (2006.01) |
| ***C25D 3/02*** | (2006.01) |
| ***C25D 17/00*** | (2006.01) |

(52) U.S. Cl.

CPC ..... *C25D 5/20* (2013.01); *C25D 3/02* (2013.01); *C25D 5/18* (2013.01); *C25D 17/06* (2013.01); *C25D 17/001* (2013.01)

(58) Field of Classification Search

None

See application file for complete search history.

(56) References Cited

U.S. PATENT DOCUMENTS 6,746,590 B2 * 6/2004 Zhang ..... C25D 5/18 204/198

OTHER PUBLICATIONS

Sarius et al (Journal of Electrochemistry and Plating Technology, vol. 1, No. 3, Oct. 2010). (Year: 2010).*

* cited by examiner

*Primary Examiner* — Louis J Rufo

(74) *Attorney, Agent, or Firm* — Osha Bergman Watanabe & Burton LLP

(57) ABSTRACT

The present invention relates to applying at least one ultra/mega sonic device and its reflection plate for forming standing wave in a metallization apparatus to achieve highly uniform metallic film deposition at a rate far greater than conventional film growth rate in electrolyte. In the present invention, the substrate is dynamically controlled so that the position of the substrate passing through the entire acoustic field with different power intensity in each motion cycle. This method guarantees each location of the substrate to receive the same amount of total sonic energy dose over the interval of the process time, and to accumulatively grow a uniform deposition thickness at a rapid rate.

14 Claims, 18 Drawing Sheets

METHOD AND APPARATUS FOR UNIFORMLY METALLIZATION ON SUBSTRATE

FIELD OF THE INVENTION

The present invention generally relates to an apparatus and a method for metallization of substrate from electrolyte solutions. More particularly, it relates to applying at least one ultra/mega sonic device to a metallization apparatus, incorporating a dynamical controlling mechanism of substrate motions for uniform applying the acoustic wave across the substrate surface, to achieve highly uniform metallic film deposition at a rate far greater than conventional film growth rate in electrolyte solutions.

BACKGROUND

Forming of a metallic layer onto a substrate bearing a thin conductive layer, usually copper, in an electrolyte environment, is implemented to form conductive lines during ULSI (ultra large scale integrated) circuit fabrication. Such a process is used to fill cavities, such as vias, trenches, or combined structures of both by electrochemical methods, with an overburden film covering the surface of the substrate. It is critical to obtain a uniform final deposit film because the subsequent process step, commonly a planarization step (such as CMP, chemical-mechanical planarization) to remove the excess conductive metal material, requires a high degree of uniformity in order to achieve the equal electrical performance from device to device at the end of production line.

Currently, metallization from electrolyte solutions is also employed in filling TSV (through silicon via) to provide vertical connections to the 3-D package of substrate stacks. In TSV application, via opening has a diameter of a few micrometers or larger, with via depth as deep as several hundreds of micrometers. The dimensions of TSV are orders of magnitude greater than those in a typical dual damascene process. It is a challenge in TSV technology to perform metallization of cavities with such high aspect ratio and depth close to the thickness approaching that of the substrate itself. The deposition rates of metallization systems designed for use in typical dual damascene process, usually a few thousand angstroms per minute, is too low to be efficiently applied in TSV fabrication.

To achieve the void-free and bottom-up gapfill in deep cavities, multiple organic additives are added in the electrolyte solutions to control the local deposition rate. During deposition, these organic components often break down into byproduct species that can alter the desired metallization process. If incorporated into deposited film as impurities, they may act as nuclei for void formation, causing device reliability failure. Therefore, during the deposition process high chemical exchange rate of feeding fresh chemicals and removing break-down byproducts in and near the cavities is needed. In addition, with high aspect ratio, vortex is formed inside the cavities below where steady electrolyte flow passes on top of the cavity openings. Convection hardly happens between the vortex and the main flow, and the transport of fresh chemicals and break-down byproducts between bulk electrolyte solution and cavity bottom is mainly by diffusion. For deep cavity such as TSV, the length for diffusion path is longer, further limiting the chemical exchange within the cavity. Moreover, the slow diffusion process along the long path inside TSV hinders the high deposition rate required by economical manufacturing. The maximum deposition rate by electrochemical methods in a mass-transfer limited case is related to the limiting current density, which is inversely proportional to diffusion double layer thickness for a given electrolyte concentration. The thinner the diffusion double layer, the higher the limiting current density, thus the higher the deposition rate possible. Patent WO/2012/174732, PCT/CN2011/076262 discloses an apparatus and method by using ultra/mega sonic in the substrate metallization to conquer the above issues.

In the plating bath used a piece of ultra/mega sonic device, the wave distribution across the ultra/mega device length is not uniform, which is proved by the power intensity test of acoustic sensor and other optical-acoustic inspection tool. To apply it on the substrate, the acoustic energy dose on each point of the substrate is not the same.

In addition, in the plating bath with an acoustic field, the wave energy lost occurs due to wave propagation absorbed by the bath wall and diffraction around the additives and byproducts. So that the power intensity of acoustic wave in the areas near the acoustic source are different from those far away from the acoustic source. A standing wave formed in two parallel planes maintains the energy within the bath to minimize the energy lost. And the energy transfer only occurs between the node and anti-node within a standing wave. However, the power intensity of wave in its node and anti-node are different, which leads to not uniform acoustic performance across substrate during process. What's more, it is difficult to control the standing wave during the entire process due to the difficulty in adjustment for the parallelism and distance between the surfaces forming standing wave.

With this method; however, a way of controlling uniformity of acoustic energy distribution further the uniformity of plating deposition must be found. And a way of controlling the acoustic field with low energy lost in the plating bath is further required.

SUMMARY

The present invention relates to applying at least one ultra/mega sonic device and its coupling reflection plate for forming standing wave in a metallization apparatus to achieve highly uniform metallic film deposition at a rate far greater than conventional film growth rate in electrolyte solutions. In the present invention, the substrate is dynamically controlled so that the position of the substrate passing through the entire acoustic field with different power intensity in each motion cycle. This method guarantees each location of the substrate to receive the same amount of total sonic energy dose over the interval of the process time, and to accumulatively grow a uniform deposition thickness at a rapid rate.

One embodiment of the present invention of an apparatus for substrate metallization from electrolyte by using ultra/mega sonic device in the bath is disclosed. It comprises an immersion bath containing at least one metal salt electrolyte, at least one electrode with individual power supply, an electricity conducting substrate holder, at least one substrate held by the substrate holder with the conductive side facing to the electrode, and an ultra/mega sonic device. The apparatus avoids the standing wave formation. The substrate holder and the electrode are oscillated by a dynamical motion actuator to pass through the acoustic area with different acoustic wave power intensity in the immersion bath. It ensures the same sonic energy dose on substrate surface in a certain cumulative time, which enhances the deposited film uniformity.

One embodiment of the present invention of an apparatus for substrate metallization from electrolyte by using ultra/mega sonic device with controlling standing wave in the bath is disclosed. It comprises an immersion bath containing at least one metal salt electrolyte, at least one electrode with individual power supply, an electricity conducting substrate holder, at least one substrate held by the substrate holder with the conductive side facing to the electrode, an ultra/mega sonic device, and a reflection plate parallel to the ultra/mega sonic device to form standing wave in the space between the reflection plate and the ultra/mega sonic device. The substrate holder and the electrode are oscillated by a dynamical motion actuator to pass through the acoustic area with different standing wave power intensity in the immersion bath. It ensures the same sonic energy dose on substrate surface in a certain cumulative time, which enhances the deposited film uniformity. In another embodiment, the space distance of the ultra/mega sonic device and the reflection plate for controlling the standing wave's formation is controlled by an oscillating actuator for further dynamic stabilizing the standing wave formation in the immersion bath.

One embodiment of the present invention of an apparatus for substrate metallization from electroless electrolyte by using ultra/mega sonic device in the bath is disclosed. It comprises an immersion bath containing at least one metal salt electrolyte, at least one substrate held by a substrate holder, and an ultra/mega sonic device. The apparatus avoids the standing wave formation. The substrate is oscillated by a dynamical motion actuator to pass through the acoustic area with different acoustic wave power intensity in the immersion bath. It ensures the same sonic energy dose on substrate surface in a certain cumulative time, which enhances the deposited film uniformity.

One embodiment of the present invention of an apparatus for substrate metallization from electroless electrolyte by using ultra/mega sonic device with controlling standing wave in the bath is disclosed. It comprises an immersion bath containing at least one metal salt electrolyte, at least one substrate held by a substrate holder, an ultra/mega sonic device, and a reflection plate parallel to the ultra/mega sonic device. The substrate is oscillated by a dynamical motion actuator to pass through the acoustic area with different standing wave power intensity in the immersion bath. It ensures the same sonic energy dose on substrate surface in a certain cumulative time, which enhances the deposited film uniformity. In another embodiment, the space distance of the ultra/mega sonic device and the reflection plate for controlling the standing wave's formation is controlled by an oscillating actuator for further dynamic stabilizing the standing wave formation in the immersion bath.

According to one embodiment of the present invention, a method for substrate metallization from electrolyte is provided. The method comprises: flowing a metal salt electrolyte into an immersion bath; transferring at least one substrate to a substrate holder that is electrically in contact with a conductive side on a surface of the substrate; applying a first bias voltage to the substrate; bringing the substrate into contact with the electrolyte; applying an electrical current to electrode; applying ultra/mega sonic to the substrate and oscillating the substrate holder; oscillating the substrate holder up and down for passing through acoustic area with different intensity; stopping applying the ultra/mega sonic and stopping oscillation of the substrate holder; applying a second bias voltage on the substrate; bringing the substrate out of the metal salt electrolyte.

According to one embodiment of the present invention, a method for substrate metallization from electrolyte is provided. The method comprises: flowing a metal salt electrolyte into an immersion bath; transferring at least one substrate to a substrate holder that is electrically in contact with a conductive side on a surface of the substrate; applying a first bias voltage to the substrate; bringing the substrate into contact with the electrolyte; applying an electrical current to electrode; applying ultra/mega sonic to the substrate and oscillating the substrate holder; oscillating the substrate holder up and down passing through acoustic area with different intensity, meanwhile, periodically changing the distance of space between the ultra/mega sonic device and the reflection plate; stopping applying the ultra/mega sonic and stopping oscillation of the substrate holder; applying a second bias voltage on the substrate; bringing the substrate out of the metal salt electrolyte.

According to one embodiment of the present invention, methods for substrate metallization from electroless electrolyte are provided.

DETAILED DESCRIPTION

According to embodiments of the present invention, ultra/mega sonic devices are utilized, and an exemplary ultra/ mega sonic device that may be applied to the present invention is described in U.S. Pat. No. 6,391,166 and WO/2009/055992.

Figure 1:
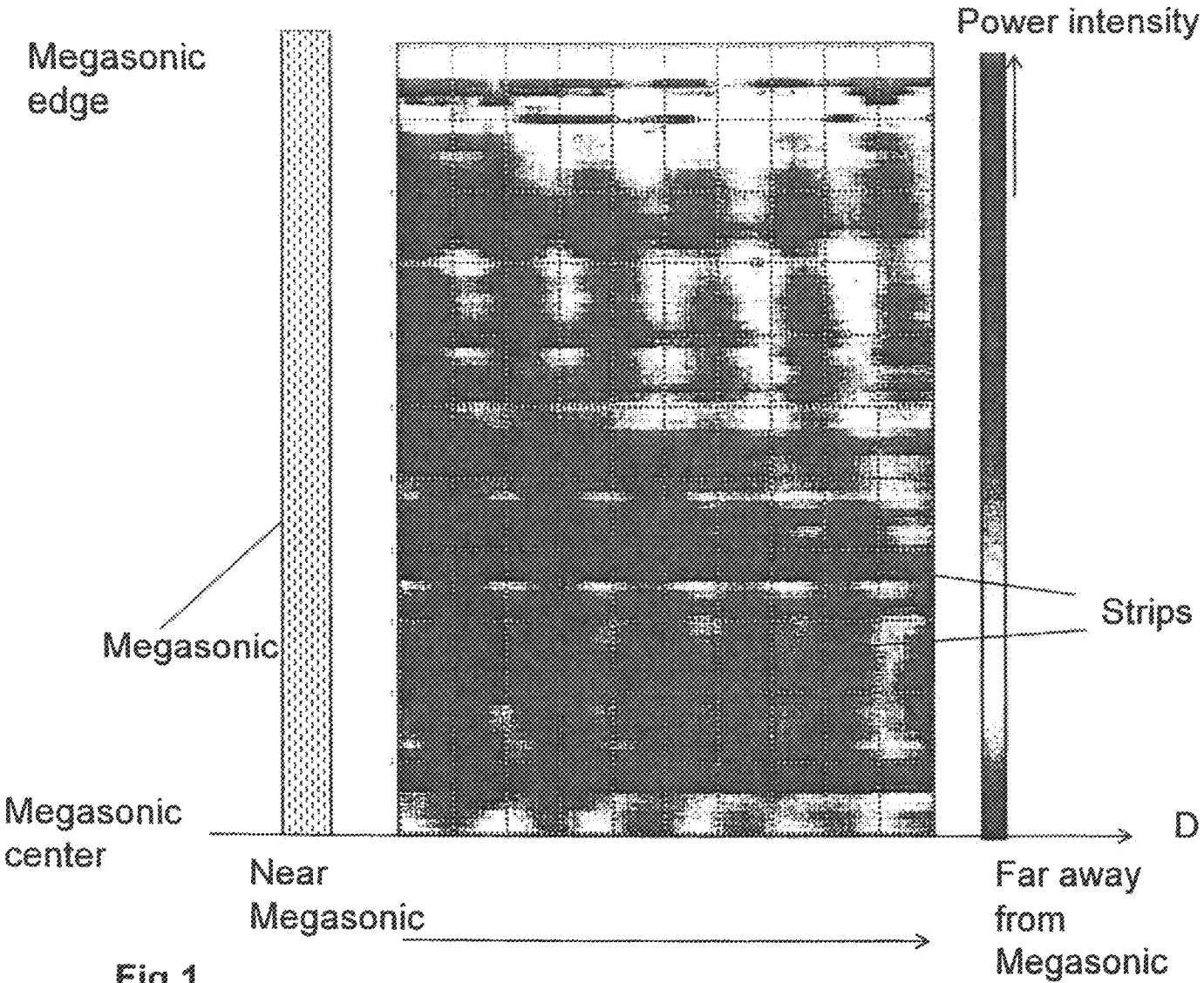
FIG. 1 shows power intensity distribution at the acoustic area at front of megasonic device.

FIG. 1 shows power intensity distribution at the area at front of a bar-shaped megasonic device. This map is obtained by a hydrophone sensor, wherein the dark area indicates high power intensity and the bright area indicates low power intensity. The power intensity distribution from the megasonic device center to edge is not uniform, wherein a plurality of dark strips with higher power intensity exit. And the power intensity distribution from the D axis normal to megasonic device surface is also not uniform, wherein power intensity is high at the area near the megasonic device and low at the area far away from the megasonic device.

Figure 2B:
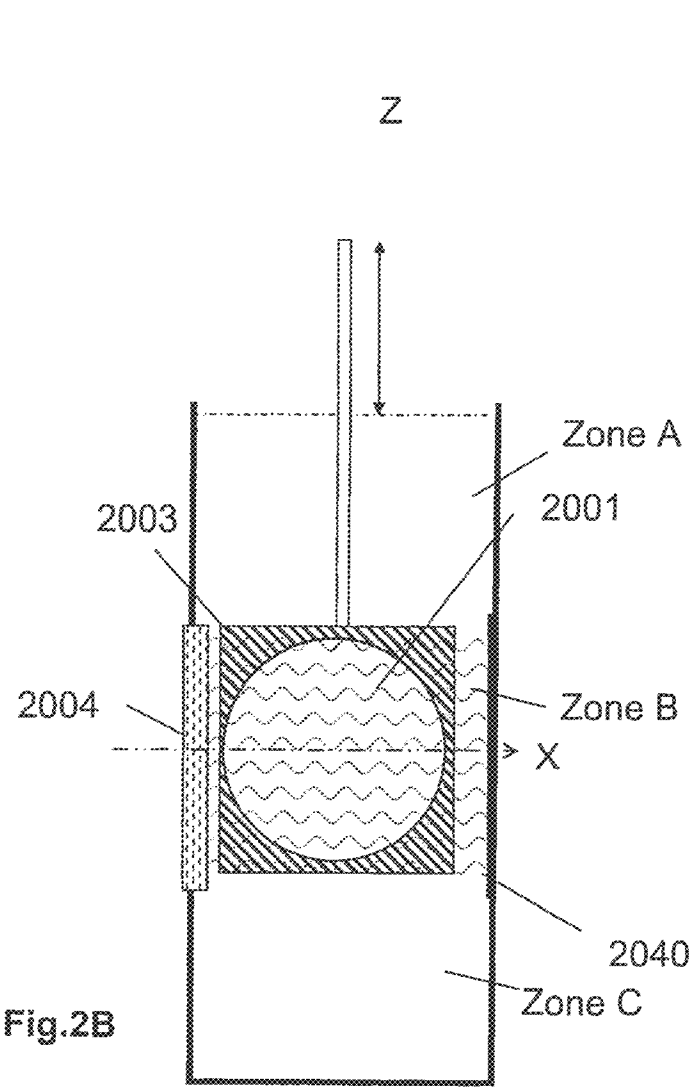
FIGS. 2A and 2B show one exemplary apparatus for metallization of substrate from electrolyte solutions.
Figure 2A:
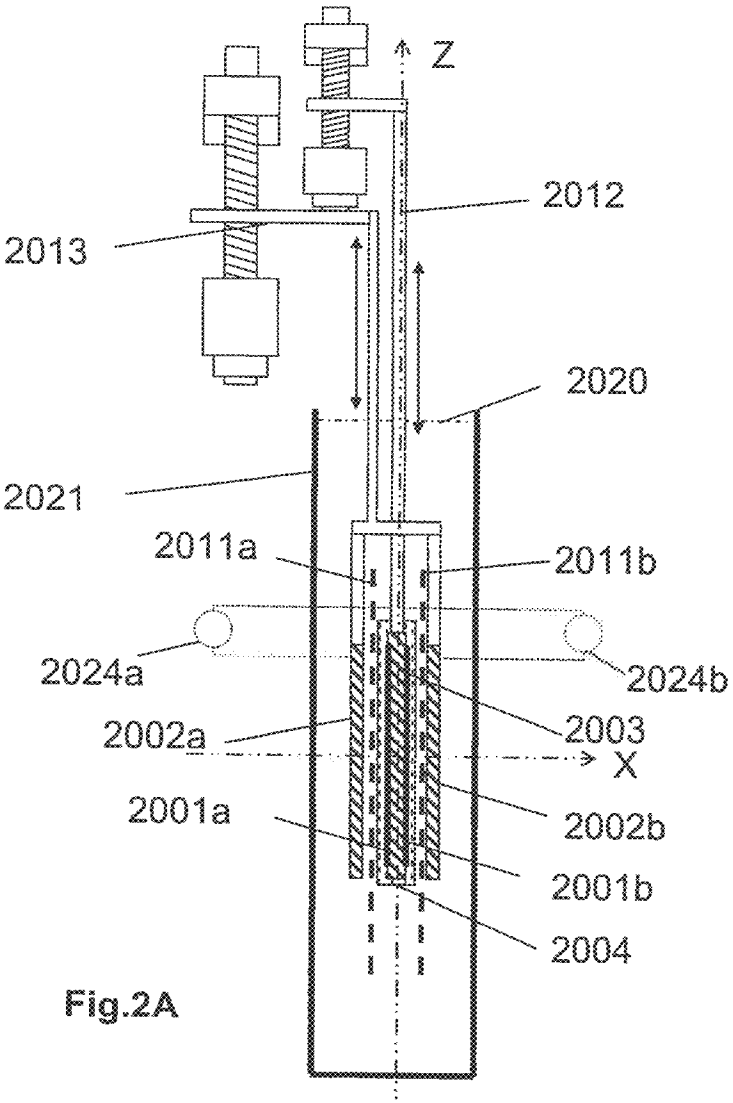

FIGS. 2A-2B show one exemplary apparatus for substrate metallization from electrolyte by using ultra/mega sonic according to an embodiment of the present invention. The apparatus includes an immersion bath 2021 containing at least one metal salt electrolyte 2020, one or two sets of electrodes 2002*a* and 2002*b* connecting to individual power supplies 2024*a* and 2024*b*, an electricity conducting substrate holder 2003 holding one or two substrates 2001*a* and 2001*b* to expose the conductive sides of the substrates 2001*a* and 2001*b* to face the electrodes 2002*a* and 2002*b*, an ultra/mega sonic device 2004, and a vertical oscillating actuator 2013 named as first actuator for moving the substrate holder 2003 and the electrodes 2002*a* and 2002*b* passing through the ultra/mega sonic area and non ultra/mega sonic area. The apparatus can be designed for processing the two substrates 2001*a* and 2001*b* at the same time or only processing one of them in the immersion bath 2021. The metal salt electrolyte 2020 flows from the immersion bath 2021 bottom to immersion bath 2021 top. At least one inlet and one outlet are positioned in the immersion bath 2021 for the metal salt electrolyte 2020 circulation. The ultra/mega sonic device 2004 is mounted on the immersion bath 2021 side wall with its surface immersed into the metal salt electrolyte 2020. An ultra/mega sonic generator is connected to the ultra/mega sonic device 2004 for generating the acoustic wave with a frequency from 20 KHz to 10 MHz and power intensity from 0.01 to 3 W/cm$^2$. The ultra/mega sonic device 2004 is made of at least one piece of piezo crystal. The acoustic wave field is formed in the space at front of the ultra/mega sonic device 2004, which is named as zone B. And the Zone A and Zone C out of the said space are non ultra/mega sonic areas. An acoustic absorption surface 2040 is facing the ultra/mega sonic device 2004 to avoid the standing wave formation. The independent power supplies 2024*a* and 2024*b* connect to each set of the electrodes 2002*a* and 2002*b*, and work in voltage-controlled mode or current-controlled mode with pre-programmed waveforms, and switch between the two modes at desired time. The applying electrical current is operable in DC mode or pulse reverse mode with pulse period from 5 ms to 2 s. Each set of electrodes 2002*a* and 2002*b* can be made in one piece or multi pieces with independent power supplies for each piece. Permeable membranes 2011*a* and 2011*b* with one layer or multi layers are set between the electrodes 2002*a* and 2002*b* and the substrate holder 2003. The substrate holder 2003 is connected to a vertical movement actuator 2012 for the substrates 2001*a* and 2001*b* loading into or unloading out of the immersion bath 2021. The actuator 2012 and the electrodes 2002*a* and 2002*b* are connected to the first oscillating actuator 2013 with amplitude from 1 to 300 mm and a frequency from 0.001 to 0.5 Hz. The first oscillating actuator 2013 oscillates the electrodes 2002*a* and 2002*b* and the substrates 2001*a* and 2001*b* up and down along Z axis which is perpendicular to the acoustic wave propagation direction. It oscillates the substrates 2001*a* and 2001*b* to ensure each point on the substrates 2001*a* and 2001*b* can pass through the entire acoustic wave field named as zone B with different power intensity, from zone B to zone A then back to zone B, from zone B to zone C then back to zone B. In this case, the sonic energy dose on each point of the substrates 2001*a* and 2001*b* is uniform over the course of process. An example of the metallization apparatus from electrolyte solutions to apply the ultra/mega sonic device is described in U.S. Pat. No. 6,391,166 and WO/2009/055992.

Figure 3:
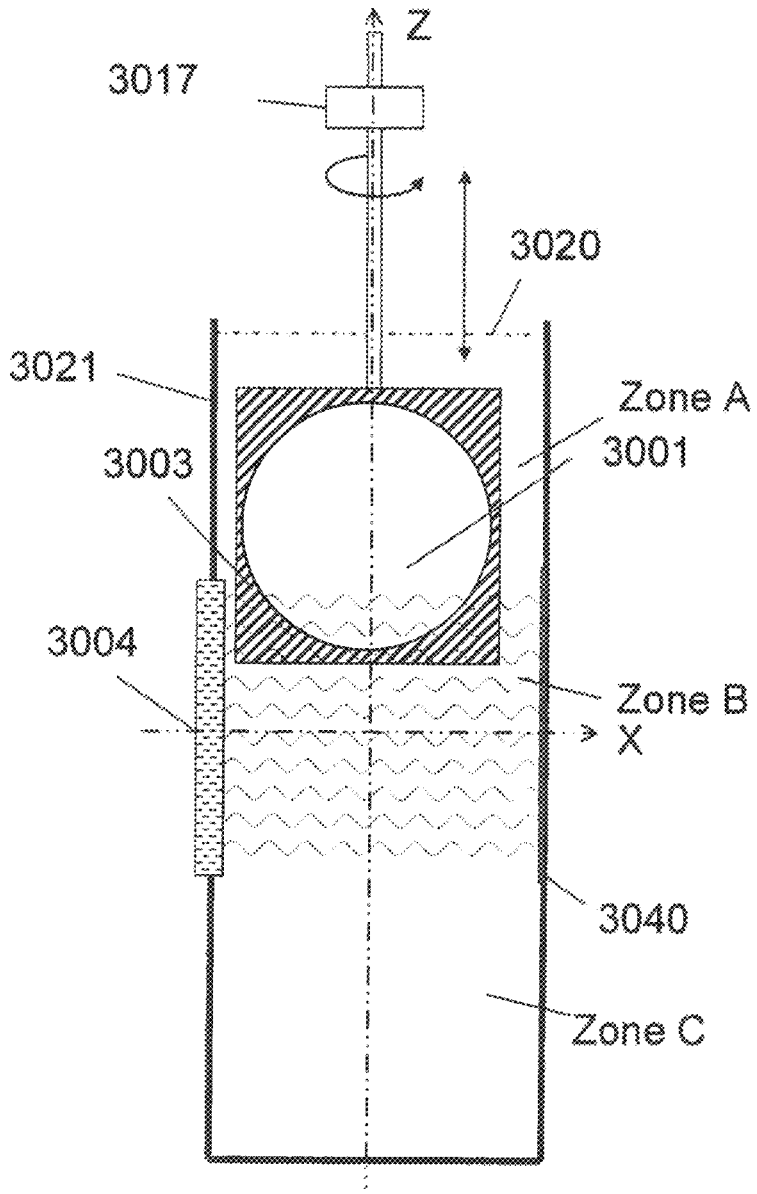
FIG. 3 shows another exemplary apparatus for metallization of substrate from electrolyte solutions and the solution distribution plate in the apparatus.

FIG. 3 shows another exemplary apparatus for substrate metallization from electrolyte by using ultra/mega sonic according to an embodiment of the present invention. The apparatus includes an immersion bath 3021 containing at least one metal salt electrolyte 3020, at least one set of electrode connecting to a corresponding power supply, an electricity conducting substrate holder 3003 holding at least one substrate 3001 to expose the conductive side of the substrate 3001 to face the electrode, an ultra/mega sonic device 3004 for forming an acoustic wave field in zone B, and a vertical oscillating actuator named as first actuator for moving the substrate holder 3003 and the electrode passing through the entire ultra/mega sonic area and non ultra/mega sonic area. An acoustic absorption surface 3040 is facing the ultra/mega sonic device 3004 to avoid the standing wave formation. A rotating actuator 3017 named as second actuator is connected to the substrate holder 3003 to flip the substrate holder 3003 180 degree around the axis of the substrate holder 3003 while the substrate holder 3003 is oscillated by the first oscillating actuator to non-acoustic zone A and zone C, so as to further uniform the acoustic wave distribution across the substrate 3001 when it passing through the acoustic zone B.

Figure 4:
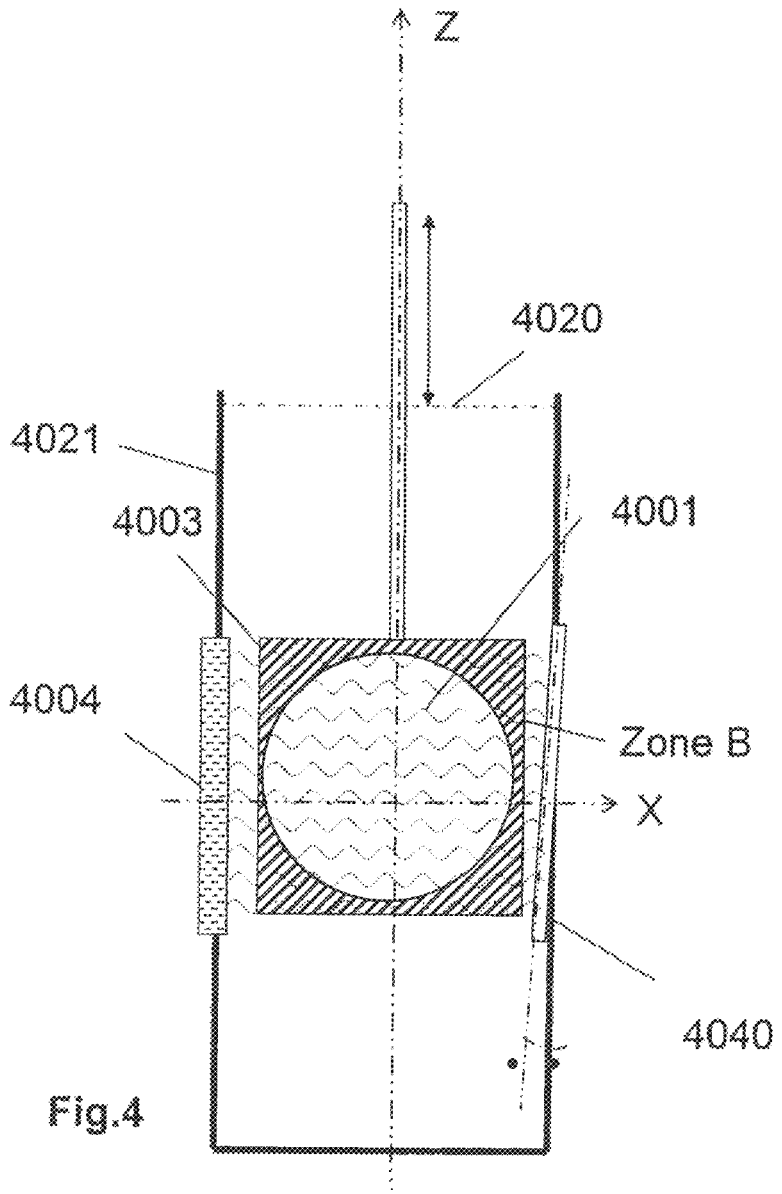
FIG. 4 shows another exemplary apparatus for metallization of substrate from electrolyte solutions.

FIG. 4 shows another exemplary apparatus for substrate metallization from electrolyte by using ultra/mega sonic according to an embodiment of the present invention. The apparatus includes an immersion bath 4021 containing at least one metal salt electrolyte 4020, at least one set of electrode connecting to a corresponding power supply, an electricity conducting substrate holder 4003 holding at least one substrate 4001 to expose the conductive side of the substrate 4001 to face the electrode, an ultra/mega sonic device 4004 for forming an acoustic wave field in zone B, and a vertical oscillating actuator named as first actuator for moving the substrate holder 4003 and the electrode passing through the ultra/mega sonic area and non ultra/mega sonic area. A slope surface 4040 with its angle $\alpha$ ($0<\alpha<45$) at the other side of the immersion bath 4021, facing the ultra/mega sonic device 4004 is used to reflect the primary acoustic wave out of the immersion bath 4021, so as to avoid the standing wave formation.

Figure 5A:
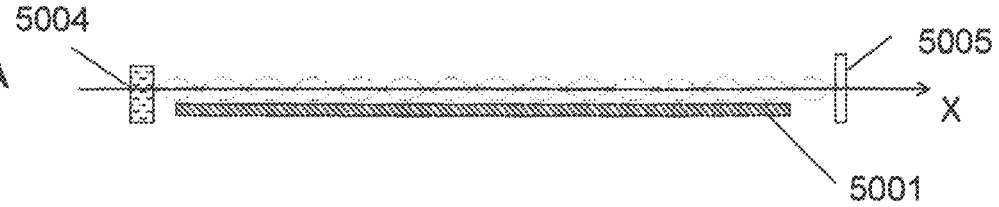
FIGS. 5A to 5B show power intensity distribution along the space between an ultra/mega sonic device and a reflection plate in an exemplary apparatus.

FIG. 5A illustrates a substrate 5001 is processed in a plating bath with standing wave across its surface. As the acoustic wave propagating in the space between the ultra/mega sonic device 5004 and its parallel reflection plate 5005, a standing wave is formed by the propagating wave interfering with its reflection wave when the distance of the space equals to $$N \cdot \frac{\lambda}{2}, N = 1, 2, 3 \ldots$$

where λ is the wavelength of the ultra/mega sonic wave and N is integers, the standing wave with highest power intensity is formed within the space. Under the condition with the space distance near the multiple half wave lengths, the standing wave is also formed but it is not that strong. The standing wave maintains the energy of within the space with high uniformity along the wave direction. The energy lost by the wave propagation in the electrolyte is minimized. In this case, the uniformity of acoustic power intensity distribution from the area near the acoustic source to that far away from the acoustic source is enhanced, and the efficiency of the acoustic generator is enhanced as well as.

Figure 5B:
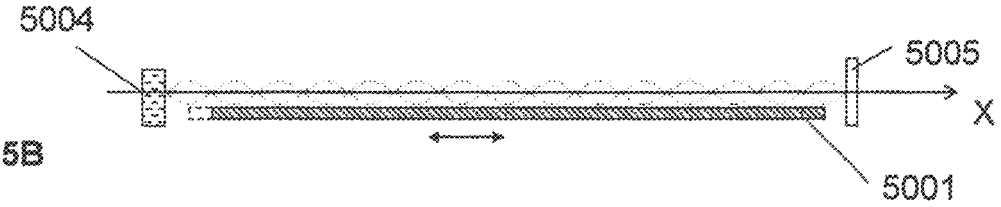

However, the energy distribution within a single length of standing wave is not uniform, due to the energy transferring between the node and anti-node of standing wave. FIG. 5B shows the substrate 5001 oscillating in the distance of a quarter of wave length, from node to anti-node, so as to get uniform wave power intensity across its surface in an accumulation time. Further, in order to keep the total sonic energy dose of the ultra/mega sonic wave on each point of the substrate 5001 the same, the oscillating distance of the substrate 5001 equals to $$N \cdot \frac{\lambda}{4}, N = 1, 2, 3 \ldots$$

where λ is the wavelength of the ultra/mega sonic wave and N is integers, each point of the substrate 5001 cross its surface obtains equal total power intensity of operating acoustic wave during an accumulation plating time. As the uniform ultra/mega sonic wave working across the substrate 5001 with low energy lost, the high plating rate and uniformity of the plated film can be achieved.

Figure 5C:
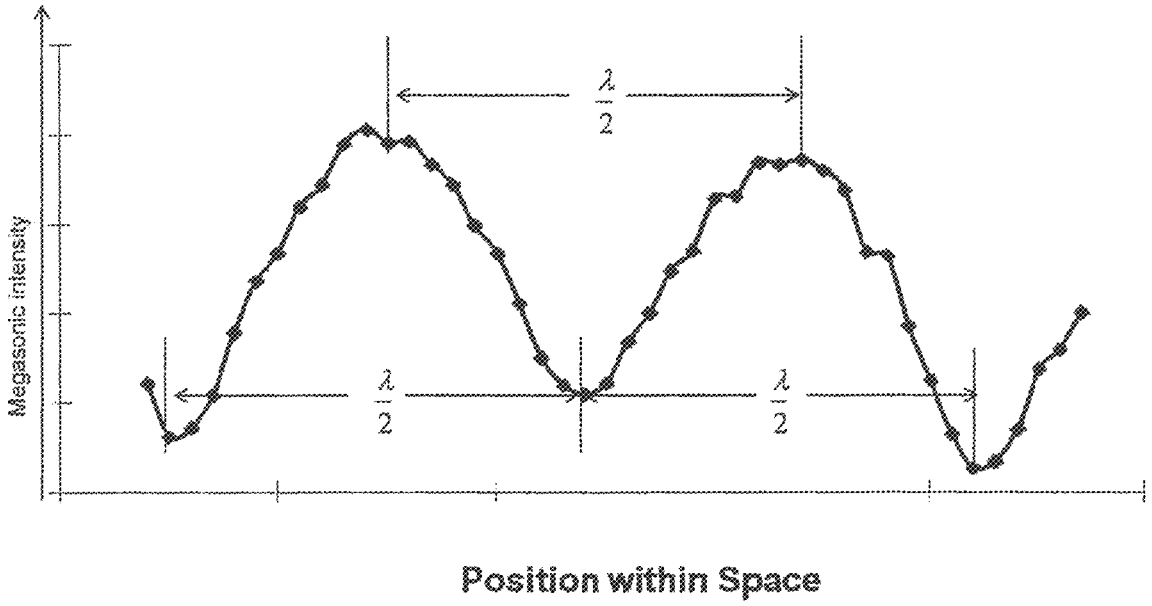
FIG. 5C shows power intensity of a fixed point within the space between the ultra/mega sonic device and the reflection plate in an exemplary apparatus.

FIG. 5C shows power intensity distribution along the space between the ultra/mega sonic device and the reflection plate in an exemplary apparatus. The results are obtained by an acoustic sensor and the measurement is performed in a plating bath with a megasonic source. It proves the power intensity changing periodically along the distance of the space between the ultra/mega sonic device and the reflection plate in the plating bath. The node to node distance is the half wave length of the megasonic source and the node to anti-node distance is a quarter of wave length of the megasonic source.

Figure 6B:
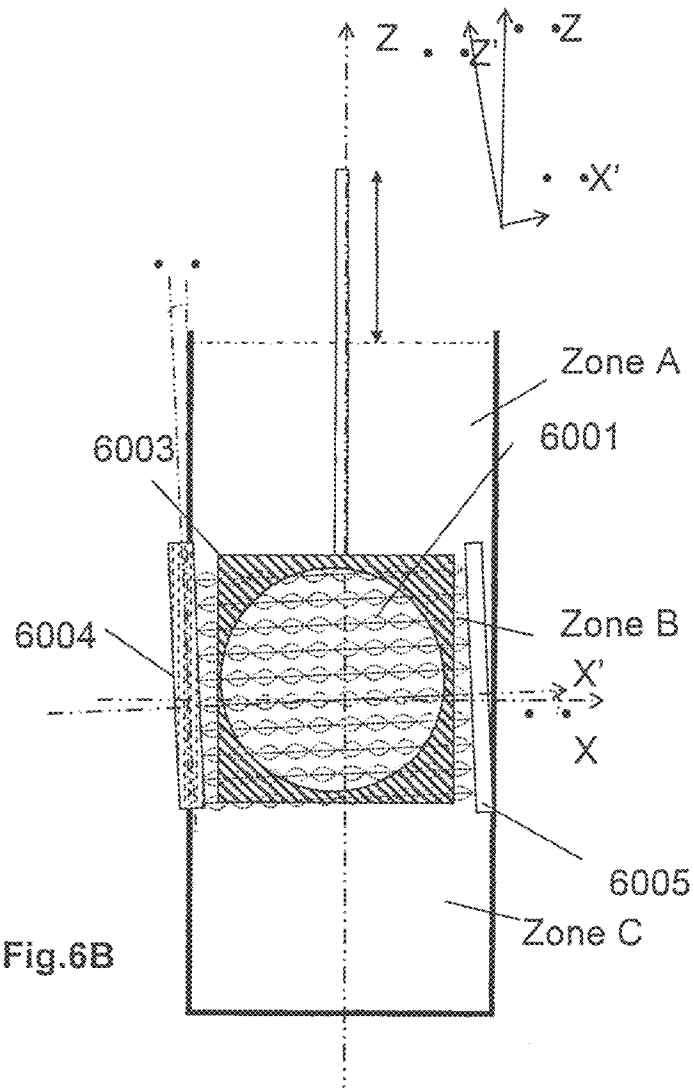
FIGS. 6A and 6B show one exemplary apparatus for metallization of substrate from electrolyte solutions.
Figure 6A:
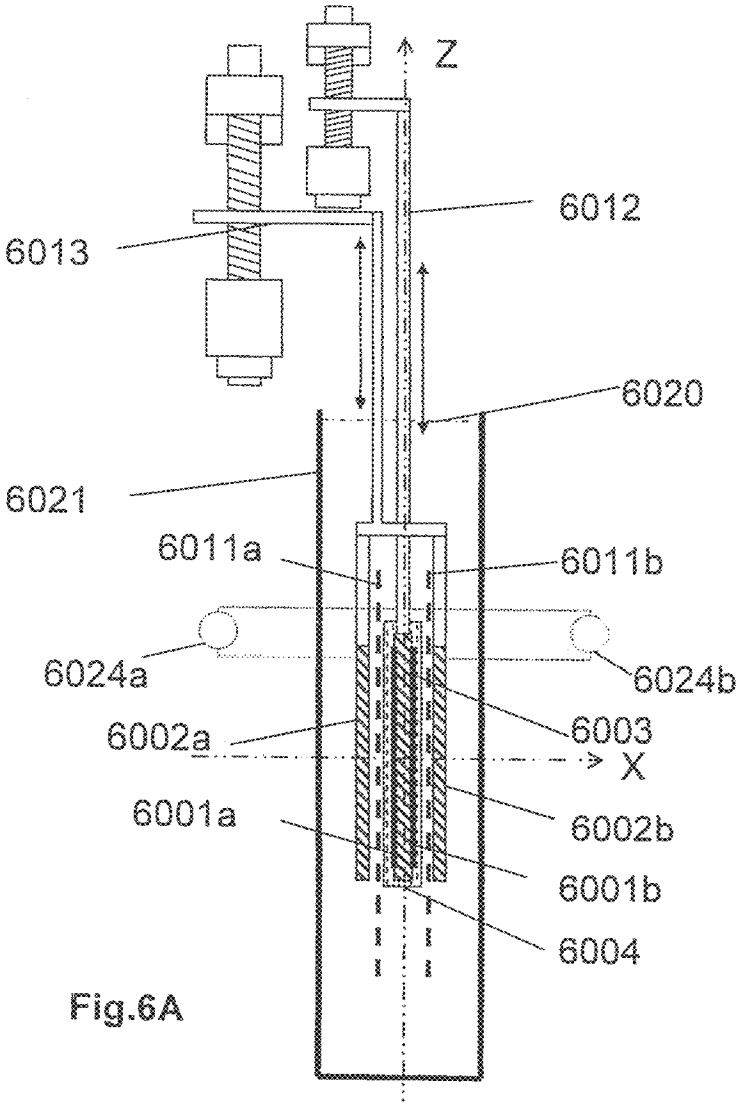

FIGS. 6A to 6B show an exemplary apparatus for substrate metallization from electrolyte by using ultra/mega sonic, standing wave in particular, according to an embodiment of the present invention. The apparatus includes an immersion bath 6021 containing at least one metal salt electrolyte 6020, two sets of electrodes 6002*a* and 6002*b* connecting to corresponding power supplies 6024*a* and 6024*b*, an electricity conducting substrate holder 6003 holding two substrates 6001*a* and 6001*b* to expose the conductive sides of the substrates 6001*a* and 6001*b* to face the electrodes 6002*a* and 6002*b*, an ultra/mega sonic device 6004 and a coupling reflection plate 6005 parallel to the ultra/mega sonic device 6004, and a vertical oscillating actuator 6013 named as first actuator for moving the substrate holder 6003 and the electrodes 6002*a* and 6002*b* passing through the ultra/mega sonic area and non ultra/mega sonic area. The apparatus can be designed for processing the two substrates 6001*a* and 6001*b* at the same time or only processing one of them in the immersion bath 6021. The metal salt electrolyte 6020 flows from the immersion bath 6021 bottom to immersion bath 6021 top. At least one inlet and one outlet are positioned in the immersion bath 6021 for the metal salt electrolyte 6020 circulation. The substrate holder 6003 is connected to a vertical movement actuator 6012 for the substrates 6001*a* and 6001*b* loading into or unloading out of the immersion bath 6021. The actuator 6012 and the electrodes 6002*a* and 6002*b* are connected to the first oscillating actuator 6013 with amplitude from 1 to 300 mm and a frequency from 0.001 to 0.5 Hz. The first oscillating actuator 6013 oscillates the electrodes 6002*a* and 6002*b* and the substrates 6001*a* and 6001*b* along Z axis which is perpendicular to the bottom plane of the immersion bath 6021 during process. The first oscillating actuator 6013 oscillates the substrates 6001*a* and 6001*b* to ensure each point on the substrates 6001*a* and 6001*b* passing through the entire acoustic wave field named as zone B with different power intensity, from zone B to zone A then back to zone B, and from zone B to zone C then back to zone B. In this case, the acoustic power intensity received by each point of the substrates 6001*a* and 6001*b* is uniform over the course of process. The ultra/mega sonic device 6004 and the reflection plate 6005 which is parallel to the ultra/mega sonic device 6004, are mounted on the opposite side walls of the immersion bath 6021 with a small angle θ(0<θ<45) to the substrate holder 6003 oscillating direction. The surfaces of the ultra/mega sonic device 6004 and its reflection plate 6005 are immersed in the metal salt electrolyte 6020, and the standing wave is formed in the space of the parallel surfaces of the ultra/mega sonic device 6004 and its reflection plate 6005. The propagation direction of the standing wave is parallel to the surfaces of the substrates 6001*a* and 6001*b*. The standing wave also tilted a said angle θ from perpendicular to the substrate holder 6003 oscillating direction. When the lateral component ΔX', along the acoustic wave direction, of oscillating distance of substrate 6001 is integral times of a quarter wave length, each point of the substrate 6001 surface is passing through nodes and anti-nodes during oscillating, obtaining the same total sonic energy dose of ultra/mega sonic wave in each cycle of oscillation. In this case, the oscillation amplitude ΔZ should equals to:

$$\Delta Z = \frac{N \cdot \frac{\lambda}{4}}{\sin\theta}, N = 1, 2, 3 \ldots$$

where λ is the wavelength of the ultra/mega sonic wave and N is integers. The reflection plate 6005 is made of one layer or multiple layers and the space can be provided between layers of the reflection plate 6005 for minimizing the acoustic energy lost. In order to keep the surface of the reflection plate 6005 parallel to the surface of the ultra/mega sonic device 6004, an adjusting component is used to set the reflection plate 6005 position.

In another embodiment of the apparatus, it further includes a rotating actuator named as second actuator to rotate the substrate holder 180 degree around the axis of the substrate holder while the substrate is within the non-acoustic areas, such as zone A or zone C.

Figure 7:
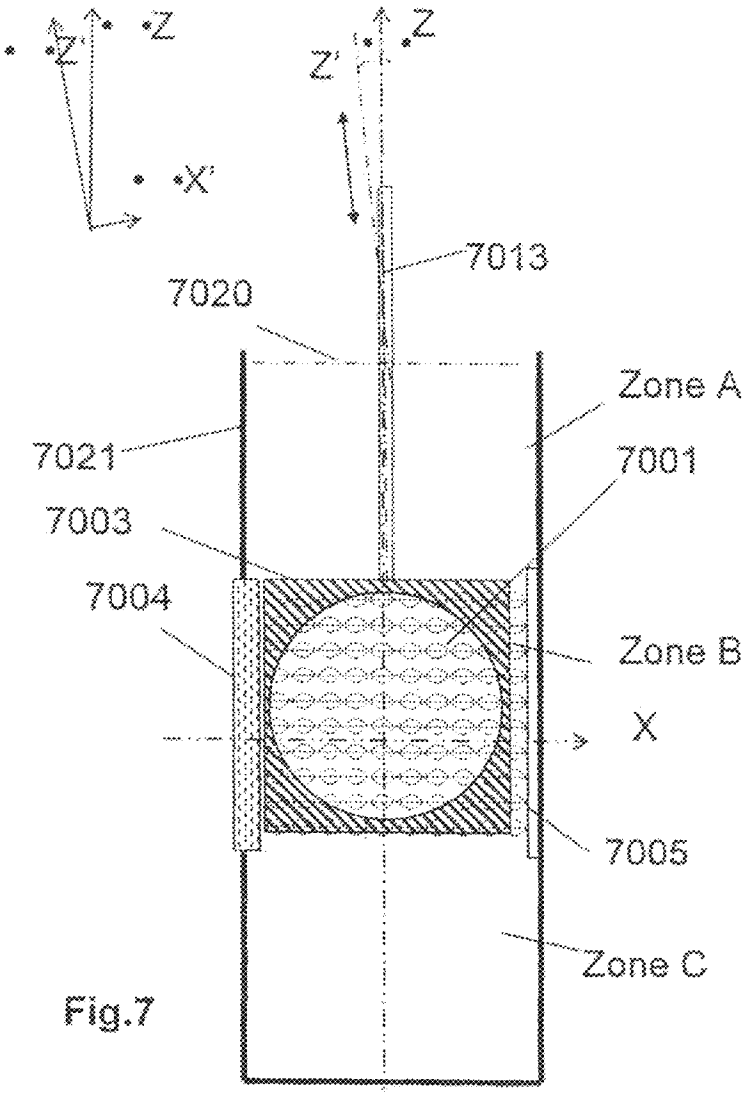
FIG. 7 shows another exemplary apparatus for metallization of substrate from electrolyte solutions.

FIG. 7 shows an exemplary apparatus for substrate metallization from electrolyte by using ultra/mega sonic, standing wave in particular, according to an embodiment of the present invention. The apparatus includes an immersion bath 7021 containing at least one metal salt electrolyte 7020, at least one set of electrode connecting to a corresponding power supply, an electricity conducting substrate holder 7003 holding at least one substrate 7001 to expose the conductive side of the substrate 7001 to face the electrode, an ultra/mega sonic device 7004 and an reflection plate 7005 parallel to the ultra/mega sonic device 7004, and a vertical oscillating actuator 7013 named as first actuator for moving the substrate holder 7003 and the electrode passing through the ultra/mega sonic area and non ultra/mega sonic area. The ultra/mega sonic device 7004 and the reflection plate 7005 parallel to the ultra/mega sonic device 7004, are mounted on the opposite side walls of the immersion bath 7021 perpendicular to the bottom plane of the bath. The surfaces of the ultra/mega sonic device 7004 and its reflection plate 7005 are immersed in the metal salt electrolyte 7020, and the standing wave is formed between the space of the parallel surfaces of the ultra/mega sonic device 7004 and its reflection plate 7005. The substrate holder 7003 is connected to the first oscillating actuator 7013, and the substrate holder 7003 is oscillated by the first oscillating actuator 7013 with an amplitude from 1 to 300 mm and a frequency from 0.001 to 0.5 Hz. The substrate holder 7003 holds the substrate 7001 to move up and down periodically along a Z' direction which is tilted a small angle $\theta(0<\theta<45)$ from Z axis that is perpendicular to the standing wave propagation direction. When the lateral component $\Delta X'$, along the standing wave direction, of oscillating distance of the substrate 7001 is integral times of a quarter wave length, each point of the substrate 7001 surface is passing through nodes and anti-nodes during oscillating, obtaining the same total power intensity of ultra/mega sonic wave in each cycle of oscillation. In this case, the oscillation amplitude $\Delta Z'$ should equals to:

$$\Delta Z' = \frac{N \cdot \frac{\lambda}{4}}{\sin\theta}, N = 1, 2, 3 \ldots$$

where $\lambda$ is the wavelength of the ultra/mega sonic wave and N is integers. Meanwhile, the lateral component $\Delta Z$ of oscillation along Z axis ensures each point on the substrate 7001 passing through entire acoustic wave field zone B with different power intensity, from zone B to zone A then back to zone B, and from zone B to zone C then back to zone B. In this case, the power intensity on each point of the substrate 7001 is uniform over the course of process.

Figure 8:
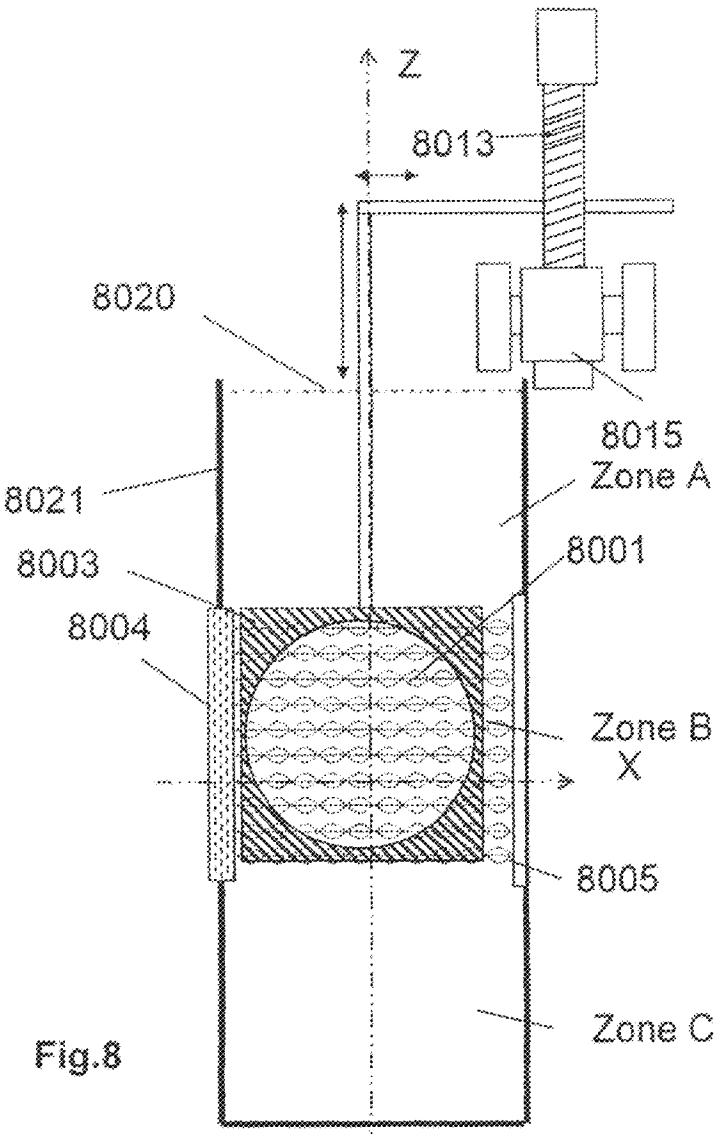
FIG. 8 shows another exemplary apparatus for metallization of substrate from electrolyte solutions.

FIG. 8 shows an exemplary apparatus for substrate metallization from electrolyte by using ultra/mega sonic, standing wave in particular, according to an embodiment of the present invention. The apparatus includes an immersion bath 8021 containing at least one metal salt electrolyte 8020, at least one set of electrode connecting to a corresponding power supply, an electricity conducting substrate holder 8003 holding at least one substrate 8001 to expose the conductive side of the substrate 8001 to face the electrode, an ultra/mega sonic device 8004 and an reflection plate 8005 parallel to the ultra/mega sonic device 8004, and a vertical oscillating actuator 8013 named as first actuator for moving the substrate holder 8003 and the electrode passing through the ultra/mega sonic area and non ultra/mega sonic area. The ultra/mega sonic device 8004 and the reflection plate 8005 parallel to the ultra/mega sonic device 8004, are mounted on the opposite side walls of the immersion bath 8021 and are perpendicular to the bottom plane of the immersion bath 8021. The surfaces of the ultra/mega sonic device 8004 and its reflection plate 8005 are immersed in the electrolyte 8020, and the standing wave is formed between the space of the parallel surfaces of the ultra/mega sonic device 8004 and the reflection plate 8005. The substrate holder 8003 is connected to the first oscillating actuator 8013, and the substrate holder 8003 and the electrode are oscillated by the first oscillating actuator 8013 along Z axis with an amplitude from 1 to 300 mm and a frequency from 0.001 to 0.5 Hz. Another oscillating actuator 8015 named as third actuator is further connected to the first oscillating actuator 8013 to oscillate the substrate holder 8003 along X axis while the first oscillating actuator 8013 oscillating along Z axis. These two oscillating actuators oscillate the substrate holder 8003 to move up and down periodically perpendicular to wave propagation direction while back and forth periodically along wave propagation direction, wherein the frequency of the oscillation along the wave propagation direction is larger than that perpendicular to wave propagation direction. When the substrate 8001 is oscillated by the oscillating actuator 8015 along X axis with an amplitude of integral times of a quarter wave length of ultra/mega sonic wave, each point of the substrate 8001 surface is passing through nodes and anti-nodes during oscillating, obtaining the same total power intensity of ultra/mega sonic wave in each cycle of oscillation along X axis.

Figure 9:
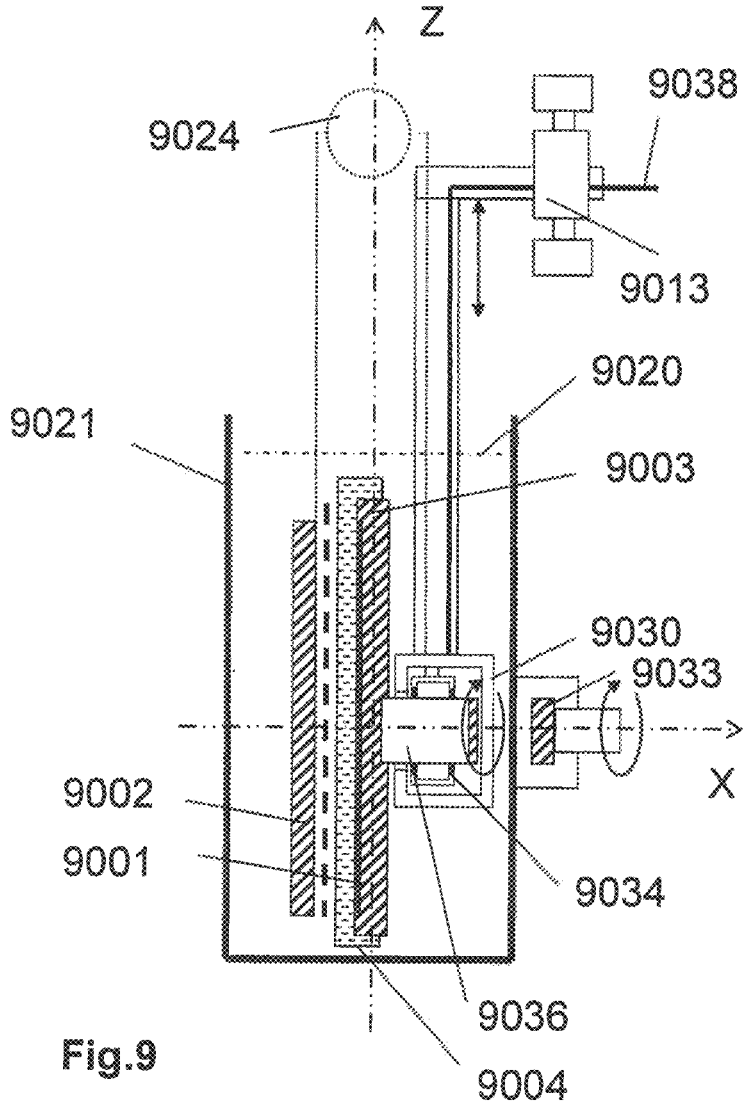
FIG. 9 shows another exemplary apparatus for metallization of substrate from electrolyte solutions.

FIG. 9 shows an exemplary apparatus for substrate metallization from electrolyte by using ultra/mega sonic, standing wave in particular, according to an embodiment of the present invention. The apparatus includes an immersion bath 9021 containing at least one metal salt electrolyte 9020, at least one electrode 9002 connecting to its individual power supply 9024, an electricity conducting substrate holder 9003 holding at least one substrate 9001 to expose the conductive side of the substrate 9001 to face the electrode 9002, an ultra/mega sonic device 9004 and a reflection plate 9005 parallel to the ultra/mega sonic device 9004, and a vertical oscillating actuator 9013 named as first actuator for moving the substrate holder 9003 passing through the ultra/mega sonic area with different power intensity. The metal salt electrolyte 9020 flows from the immersion bath 9021 bottom to immersion bath 9021 top. At least one inlet and one outlet are positioned in the immersion bath 9021 for electrolyte 9020 circulation. The ultra/mega sonic device 9004 and the reflection plate 9005 parallel to the ultra/mega sonic device 9004, are mounted on the opposite side walls of the immersion bath 9021. The surfaces of the ultra/mega sonic device 9004 and its reflection plate 9005 are immersed in the electrolyte 9020, and the standing wave is formed between the space of the parallel surfaces of the ultra/mega sonic device 9004 and its reflection plate 9005. A rotation component 9036 is connected to the substrate holder 9003 with the rotation speed in the range of 10 rpm to 300 rpm. A rotating actuator 9033 named as fourth actuator placed at outside wall of the immersion bath 9021 provides the force to drive the rotation component 9036 by the magnetic coupling mechanism. A connecting component 9030 is used to connect the first oscillating actuator 9013 and the rotation component 9036 together with good sealing. The substrate holder 9003 is oscillated by the first oscillating actuator 9013 along the Z axis with the amplitude in range of 1 to 300 mm while it is rotated by the rotation component 9036. In this case, the acoustic power intensity received by each point of the substrate 9001 is uniform over the course of process. The connecting component 9030 also provides electrical conduction to the substrate through the contact 9034 during the substrate 9001 rotation. A gas line 9038 provides gas in to the connecting component 9030, maintaining a positive pressure inside so as to keep the electrolyte 9020 outside.

Figure 10A:
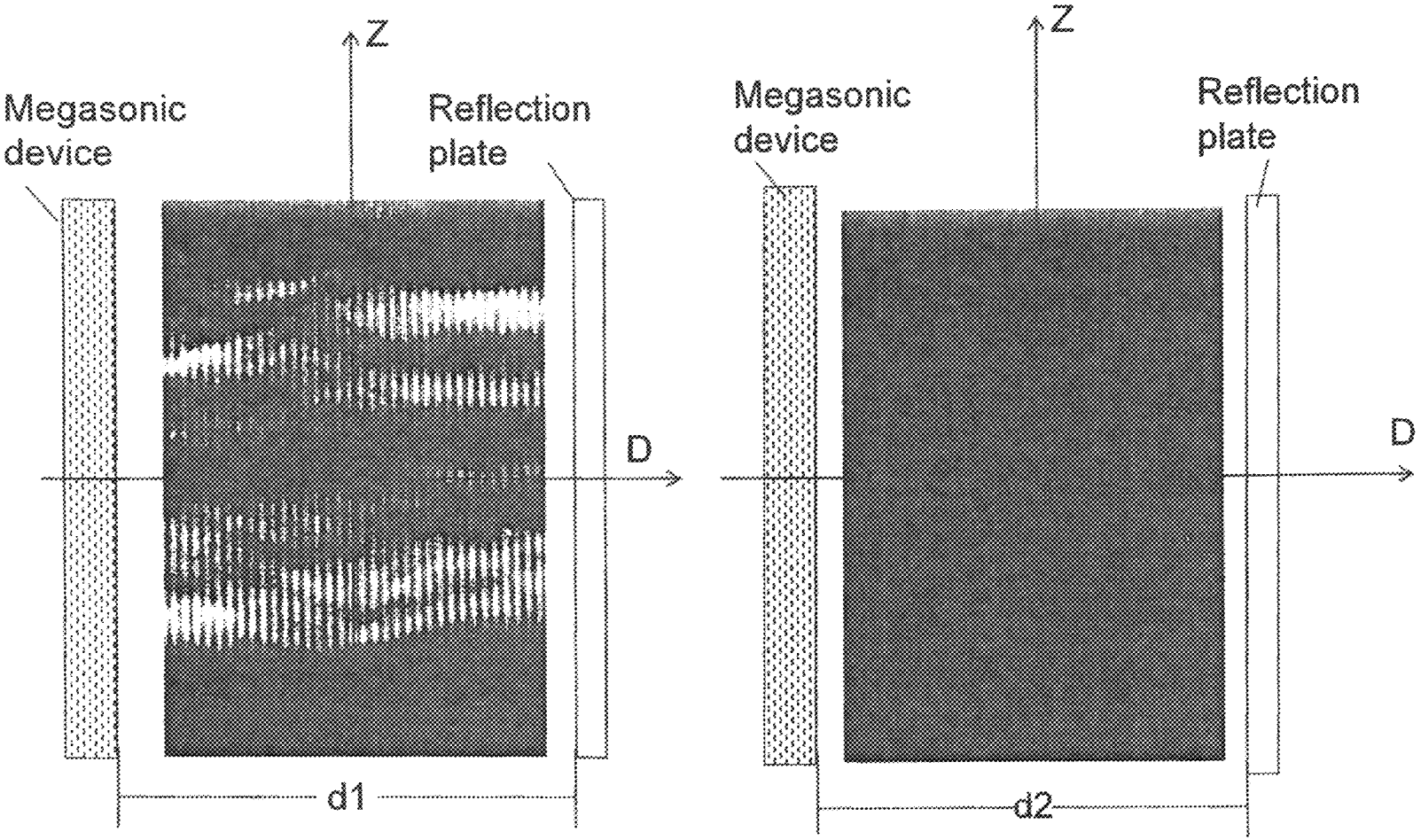
FIGS. 10A and 10B show the power intensity between an ultra/mega sonic device and a reflection plate changes while the distance of the space between the ultra/mega sonic device and the reflection plate changing.
Figure 10B:
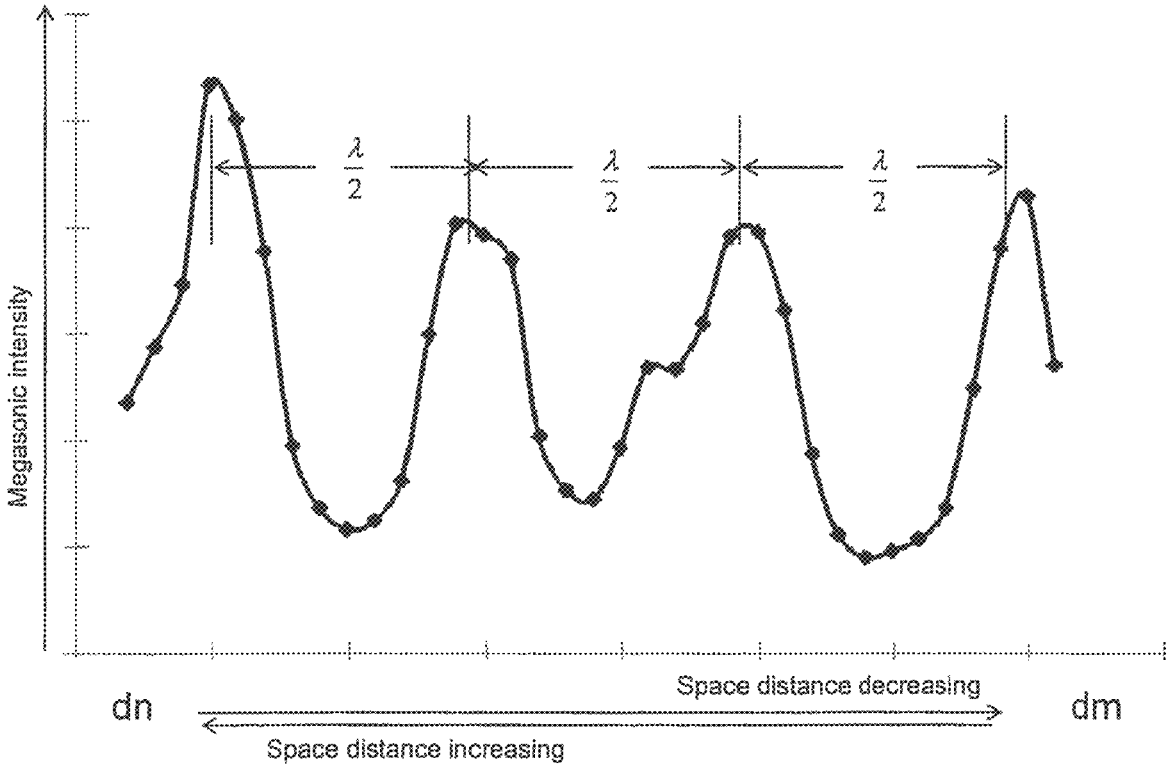

FIG. 10A shows power intensity distribution map within the space between the ultra/mega sonic device and the reflection plate in an exemplary apparatus while the distance of the space changing. The power intensity distribution map of the space between the ultra/mega sonic device and its reflection plate is measured by an acoustic testing station, wherein the dark area indicates low power intensity and bright area indicates high power intensity. The alternative dark and bright lines along the Z axis in the power intensity distribution map discloses the formation of the standing wave, wherein the node at darkest line and anti-node at brightest line. The dark strips along D axis in the power intensity distribution map disclose a not uniform power intensity distribution across the megasonic device length. The distance of space between the ultra/mega sonic device and its reflection plate is marked as d. To change the distance d from d1 to d2 (d1≠d2), the power intensity map changes from brightest to darkest; herein d2−d1 is quarter wave length of the megasonic wave. It discloses the standing wave formation in the immersion bath is different when the distance of said space between the ultra/mega sonic device and the reflection plate varying. FIG. 10B shows power intensity of a fixed point within the space between the ultra/mega sonic device and the reflection plate in an exemplary apparatus while the distance of the space changing. The results are obtained by an acoustic sensor and the measurement is performed in an immersion bath with a megasonic source while the distance of the space decreasing from dn to dm. It discloses the power intensity changing periodically while the distance of the space between the ultra/mega sonic device and the reflection plate changing. The peak power intensity is achieved when the immersion bath meet the condition of standing wave formation when the distance of the space is the integral times of wave length, wherein the energy is maintained between the space with minimum energy lost.

Figure 11A:
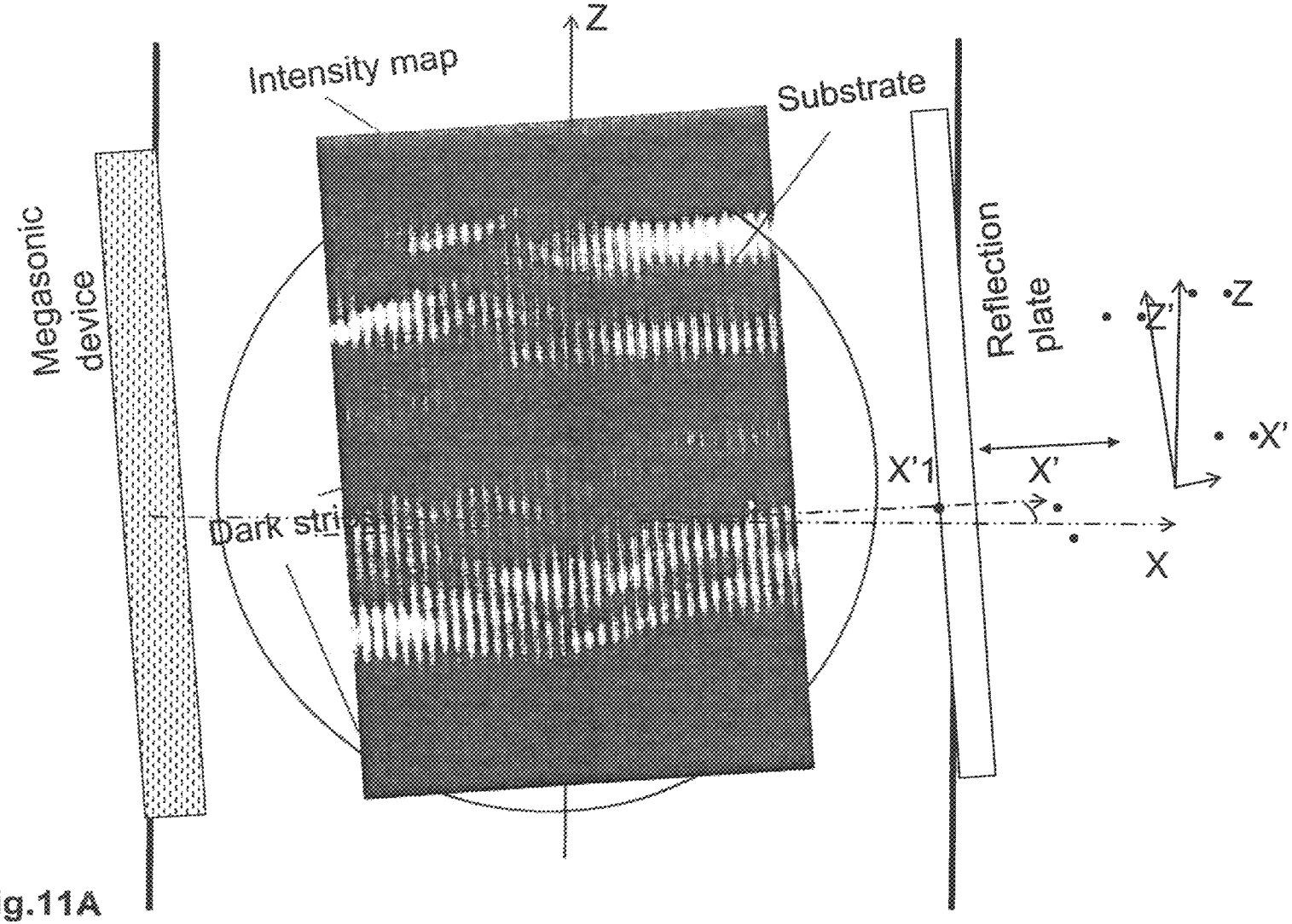
FIGS. 11A and 11B illustrate the motion of substrate along Z axis and the motion of reflection plate along X' direction.
Figure 11B:
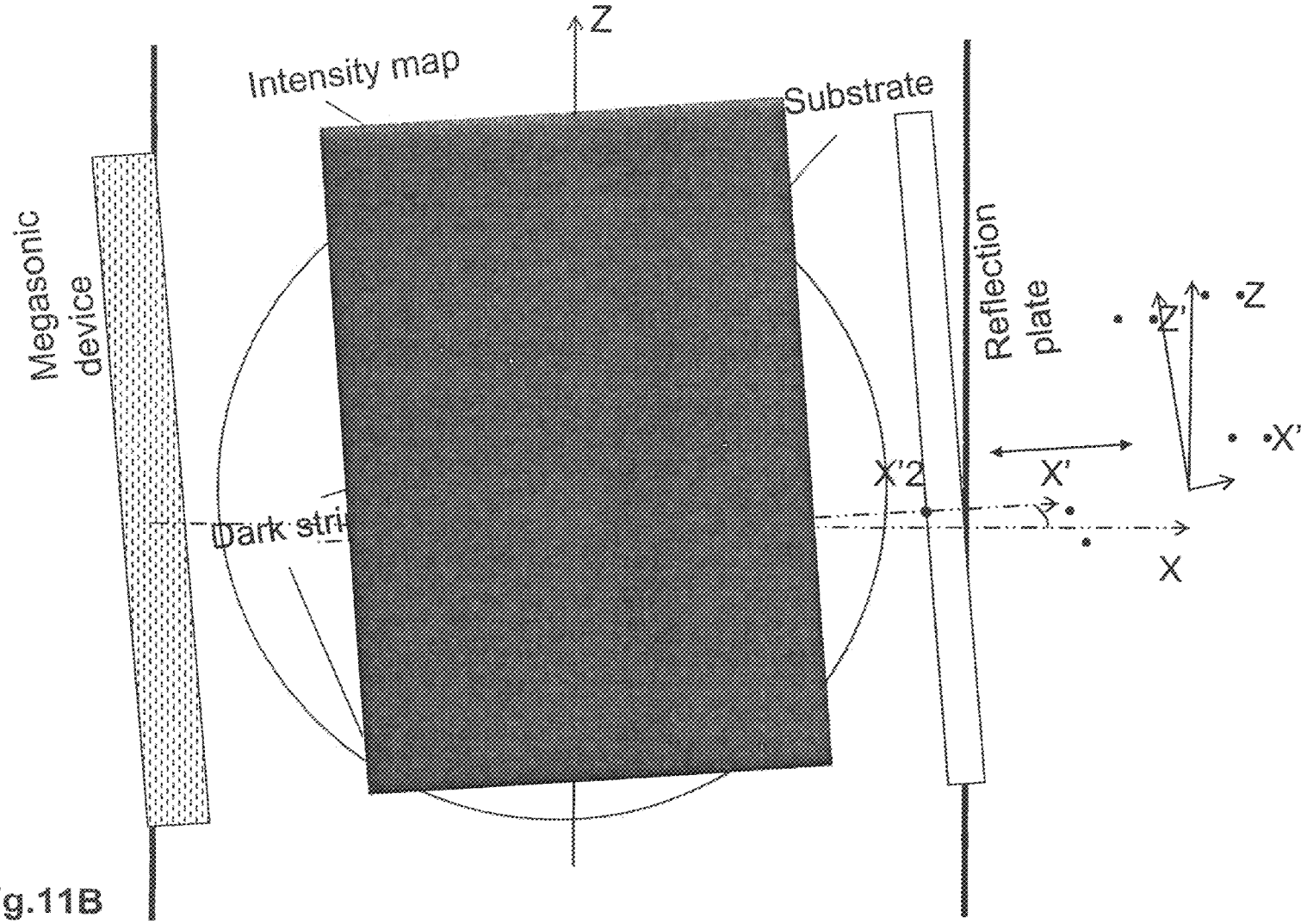

FIGS. 11A and 11B illustrate the dynamic motions of the substrate and the reflection plate during the process of plating. The power intensity distribution map of the space between the ultra/mega sonic device and its reflection plate is measured by an acoustic testing station, wherein the dark area indicates low power intensity and bright area indicates high power intensity. The alternative dark and bright lines along the Z axis in the power intensity distribution map discloses the formation of the standing wave, wherein the node at darkest line and anti-node at brightest line. The dark strips along X' axis in the power intensity distribution map discloses a not uniform power intensity distribution across the megasonic device length. To oscillate the substrate along Z axis with the amplitude of $$\Delta Z = \frac{N \cdot \frac{\lambda}{4}}{\sin\theta}, N = 1, 2, 3 \ldots$$

where λ is the wavelength of the ultra/mega sonic wave and N is integers, the lateral component movement along Z' axis, an angle θ(0<θ<45) tilted from Z axis, leads the each point on the substrate passing through the strips, and the lateral component movement along to X' axis, an angle θ(0<θ<45) tilted from X axis, leads the each point on the substrate passing through node and anti-node of the standing wave in each oscillation cycle. Meanwhile, the reflection plate oscillates along X' axis with the amplitude of integral times of half wave length, so as to ensuring the total power intensity between the space in each oscillation cycle the same. Herein the oscillation speed of the reflection plate is faster than the oscillation speed of the substrate. This is a solution for the difficulty in the parallelism adjustment of the reflection plate to meet the best standing wave condition. It also make the immersion bath acoustic wave field stable between each oscillating period, if the condition of the immersion bath is unstable by time.

Figure 12B:
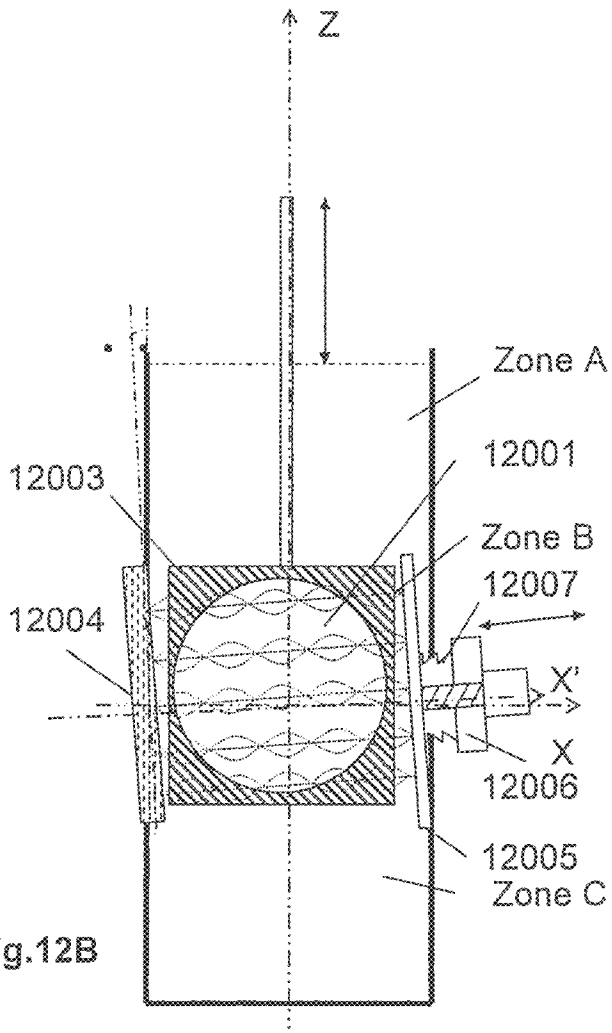
FIGS. 12A to 12C show another exemplary apparatus for metallization of substrate from electrolyte solutions.
Figure 12A:
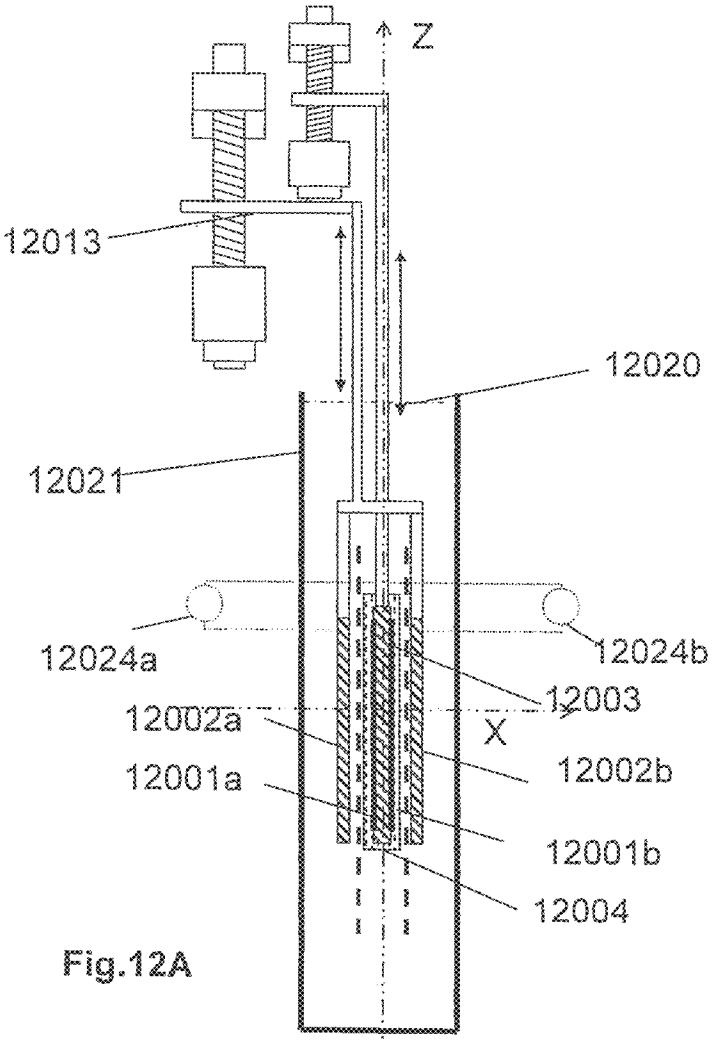
Figure 12C:
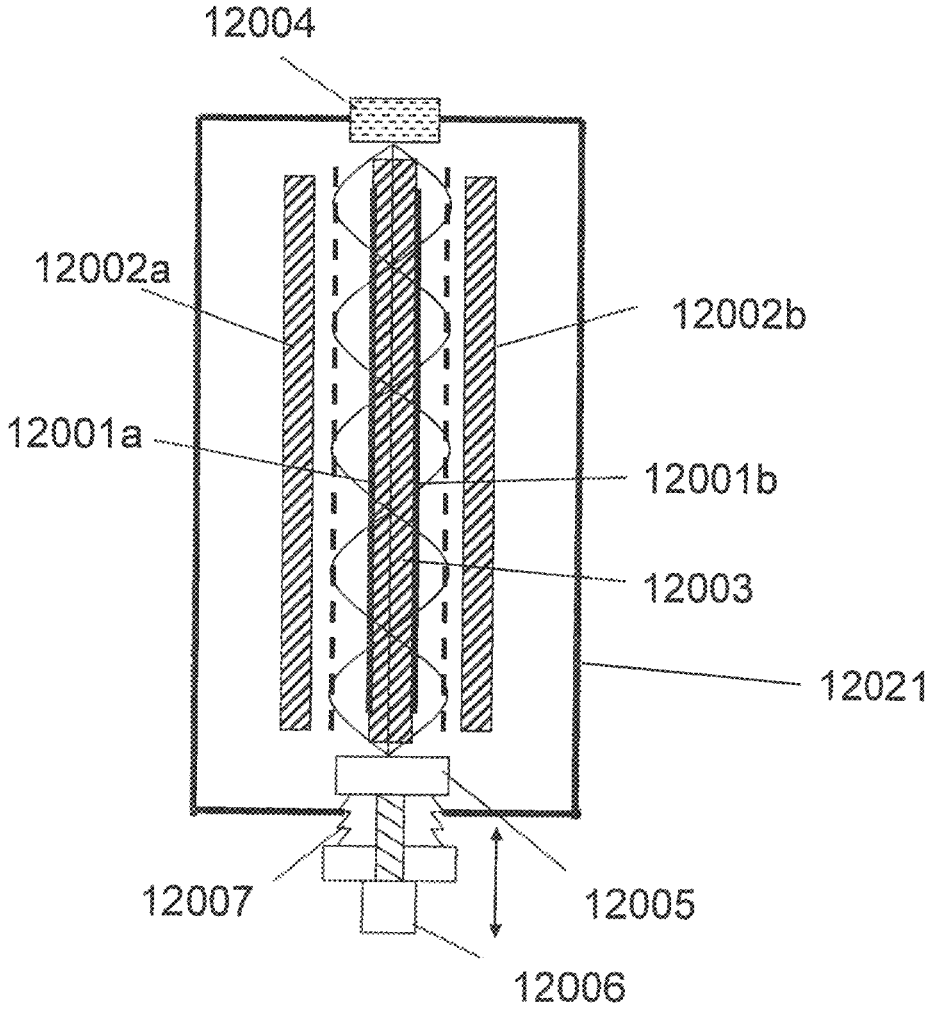

FIGS. 12A to 12C show an exemplary apparatus for substrate metallization from electrolyte by using ultra/mega sonic, standing wave in particular, according to an embodiment of the present invention. The apparatus includes an immersion bath 12021 containing at least one metal salt electrolyte 12020, two sets of electrodes 12002*a* and 12002*b* connecting to the corresponding power supplies 12024*a* and 12024*b*, an electricity conducting substrate holder 12003 holding two substrates 12001*a* and 12001*b* to expose the conductive sides of the substrates 12001*a* and 12001*b* to face the electrodes 12002*a* and 12002*b*, an ultra/mega sonic device 12004 and a coupling reflection plate 12005 parallel to the ultra/mega sonic device 12004, a vertical oscillating actuator 12013 named as first actuator for moving the substrate holder 12003 passing through the ultra/mega sonic area and non ultra/mega sonic area, and an oscillating actuator 12006 connecting to the reflection plate 12005. The oscillating actuator 12006 is mounted with the reflection plate 12005 from its backside with a bellow component 12007 for flexible sealing, oscillating the reflection plating 12005 back and forth along X' axis, wave propagation direction, so as to change the distance of the space between ultra/mega sonic device 12004 and reflection plate 12005. The oscillating actuator 12006 has a frequency operated from 1 to 10 Hz and amplitude equaling to N time of half wave length of ultra/mega sonic wave, N is an integer number from 1 to 10. The oscillating actuator 12006 works while said first oscillating actuator 12013 moving the substrates 12001*a* and 12001*b* passing through entire acoustic zone B with different power intensity, from zone B to zone A then back to zone B, from zone B to zone C then back to zone B. Herein the oscillation speed of the oscillating actuator 12006 is faster than the oscillation speed of the first oscillating actuator 12013.

Figure 13:
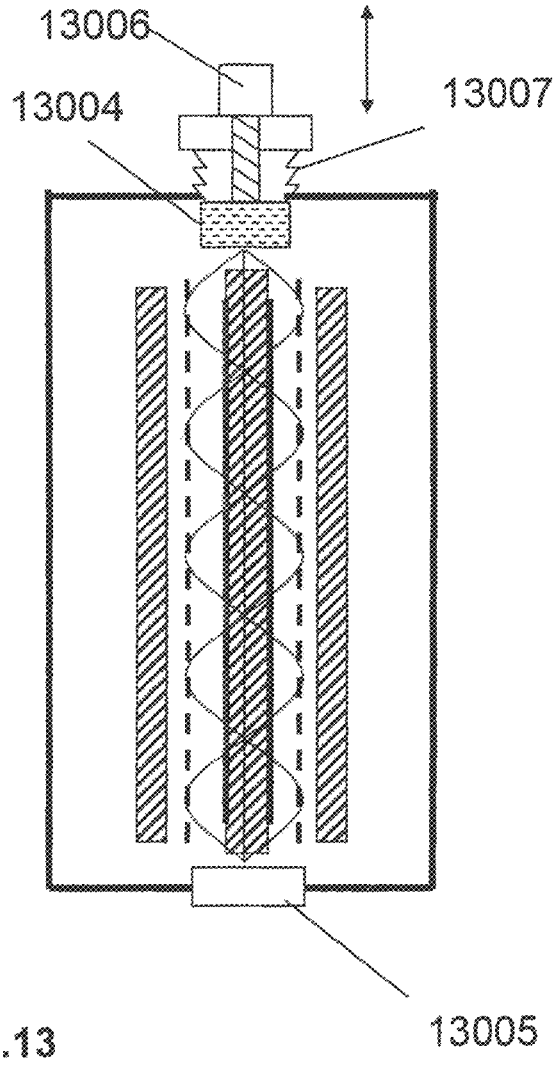
FIG. 13 shows another exemplary apparatus for metallization of substrate from electrolyte solutions.

FIG. 13 shows an exemplary apparatus for substrate metallization from electrolyte by using ultra/mega sonic, standing wave in particular, according to an embodiment of the present invention. An oscillating actuator 13006 is mounted with the ultra/mega sonic device 13004 from its backside with a bellow component 13007 for flexible sealing, oscillating the ultra/mega sonic device 13004 back and forth along its axis, wave propagation direction, so as to change the distance of the space between ultra/mega sonic device 13004 and reflection plate 13005. The oscillating actuator 13006 has a frequency operated from 1 to 10 Hz and amplitude equaling to N time of half wave length of ultra/mega sonic wave, N is a integer number from 1 to 10.

Figure 14:
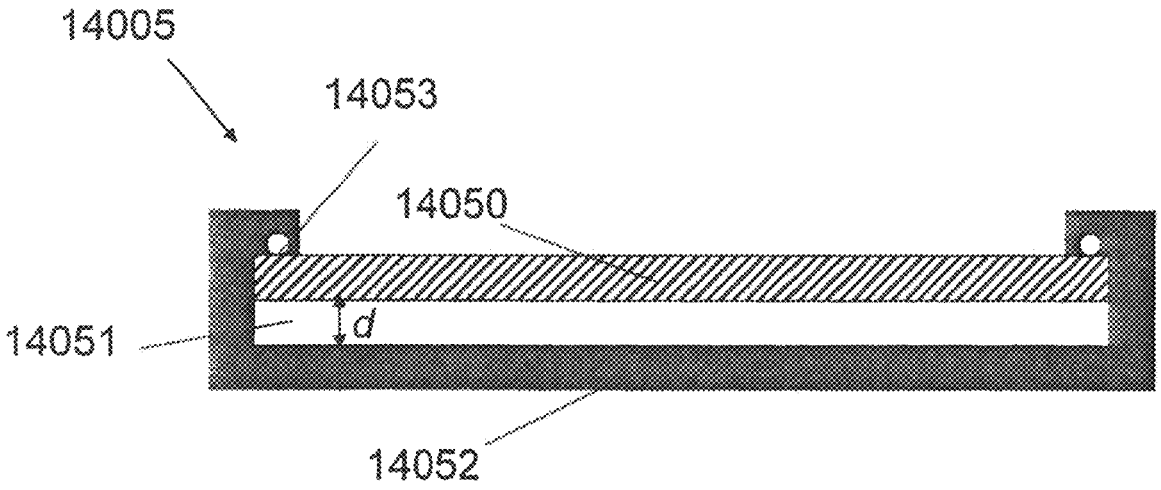
FIG. 14 shows one exemplary reflection plate in the apparatus for metallization of substrate from electrolyte solutions.

FIG. 14 shows one exemplary of reflection plate in the apparatus according to an embodiment of the present invention. The reflection plate 14005 is made of one or multiple layers of solid plates 14050 and 14052. An air gap of 14051 is provided between two solid plates 14050 and 14052 for increasing the reflection rate of the reflection plate 14005 and minimizing the acoustic energy lost. A seal ring 14053 is provided between the two solid plates 14051 and 14052 to prevent the electrolytes leakage to the air gap 14051. In one embodiment, the solid plate 14050 of the reflection plate 14005 is made of thin quartz material with thickness of n time of half wavelength of ultra/mega sonic wave; n is integer number from 1 to 100.

Figure 15:
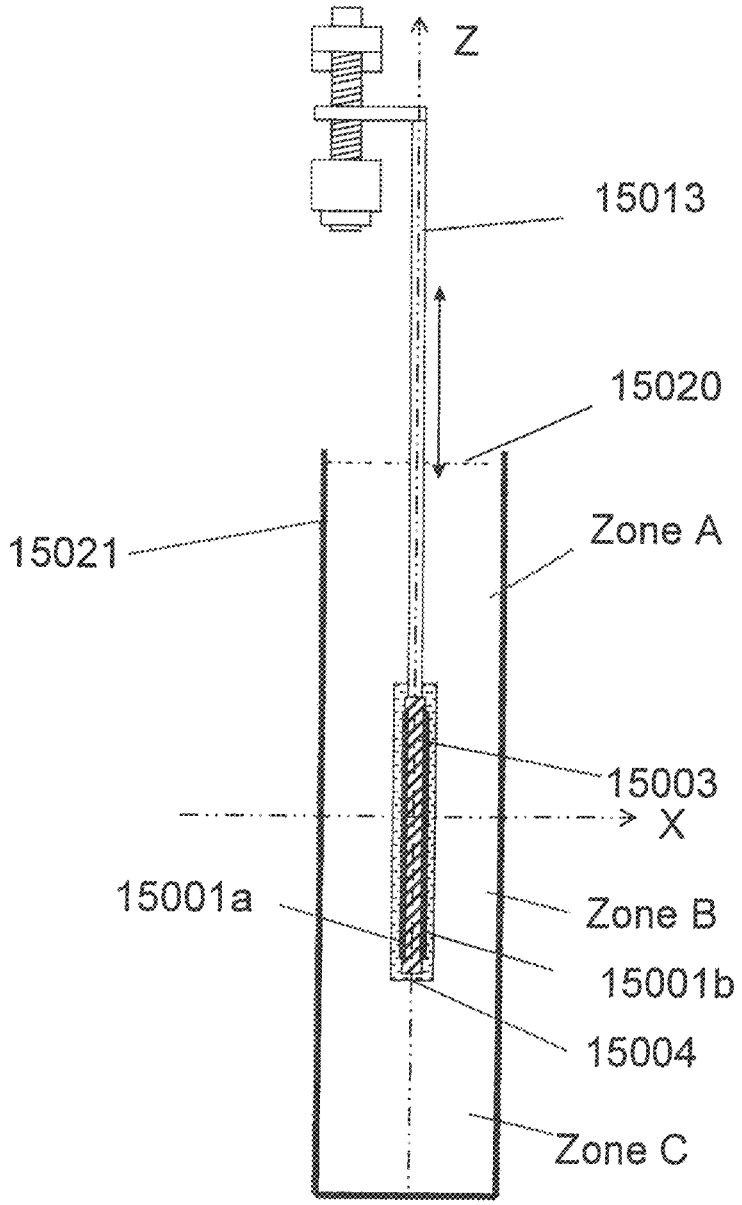
FIG. 15 shows another exemplary apparatus for metallization of substrate from electrolyte solutions.

FIG. 15 shows an exemplary apparatus for substrate metallization from electroless electrolyte by using ultra/mega sonic according to an embodiment of the present invention. The apparatus includes an immersion bath 15021 containing at least one metal salt electrolyte 15020, a substrate holder 15003 holding two substrates 15001*a* and 15001*b* with the plated sides exposed into the electrolyte 15020, an ultra/mega sonic device 15004, an oscillating actuator 15013, named as first actuator, for moving the substrate holder 15003 passing through the ultra/mega sonic area and non ultra/mega sonic area. The substrate holder 15003 is available for arraying multiple substrates to be processed in the immersion bath 15021 at the same time. The first oscillating actuator 15013 oscillates the substrate holder 15003 along Z axis which is perpendicular to the bottom plane of immersion bath 15021 during process. It oscillates the substrates to ensure each point on the substrates passing through entire acoustic zone B with different power intensity, so as to resulting in an uniformed power intensity distribution across the substrates held by the substrate holder 15003 in an accumulated time. When the substrates 15001*a* and 15001*b* are oscillated to the non-acoustic zone of zone A and zone C, they are rotated 180 degree to further uniform the sonic energy through the substrates surfaces.

In another embodiment of an apparatus for substrate metallization from electroless electrolyte, a reflection plate is placed parallel to the ultra/mega sonic device 15004 to generating standing wave in the immersion bath. The apparatus includes an immersion bath containing metal salt electrolyte, at least one ultra/mega sonic device coupled with said reflection plate, a first oscillating actuator oscillating the substrate holder along its axis, through the entire standing wave area with different ultra/mega sonic power intensity, so as to resulting in an uniformed power intensity distribution across the substrate in an accumulated time. The distance of the space between the ultra/mega sonic device and reflection plate is controlled for standing wave formation and distribution.

One method applied to the metallization apparatus with an ultra/mega sonic device can be set as follows:

Process Sequence

Step 1: introduce a metal salt electrolyte into said apparatus, wherein the metal salt electrolyte contains at least one cationic form of the following metals: Cu, Au, Ag, Pt, Ni, Sn, Co, Pd, Zn.

Step 2: transfer a substrate to one side of substrate holder or two substrates to both sides of substrate holder and the conductive side of the substrate is exposed to face electrode, the substrate holder is electricity conducting.

Step 3: apply a small bias voltage up to 10V to the substrate;

Step 4: bring the substrate into electrolyte, and the conductive side of the substrate are in full contact with the electrolyte.

Step 5: apply electrical current to each electrode; the power supplies connected to electrodes switch from voltage mode to current mode at desired times;

Step 6: maintain constant electrical current on electrode with the electrical current range from 0.1 A to 100 A and turn on ultra/mega sonic device; the power intensity of ultra/mega sonic device is in the range of 0.01 to 3 W/cm$^2$; the frequency of ultra/mega sonic device is set between 20 KHz to 10 MHz; in another embodiment, the applying electrical current is operable pulse reverse mode with pulse period from 5 ms to 2 s;

Step 7: oscillate the substrate passing through entire acoustic zone B with different power intensity, from zone B to zone A then back to zone B, from zone B to zone C then back to zone B; the substrate holder oscillation amplitude range is from 1 mm to 300 mm and its frequency is 0.001 to 0.5 Hz;

Step 8: turn off ultra/mega sonic device and stop oscillation of the substrate holder;

Step 9: switch power supply to a small bias voltage mode from 0.1V to 0.5V, and apply it on the substrate;

Step 10: bring the substrate out of the electrolyte;

Step 11: stop power supply and clean off the residue electrolyte on a surface of the substrate.

The above method is applied for metallization in the deep cavities on the substrate with dimensions of 0.5 to 50 μm in width and 5 to 500 μm in depth.

In another embodiment, the substrate flips at 180 degree while it oscillating to zone A and zone C in step 7.

Another method applied to the metallization apparatus with an ultra/mega sonic device can be set as follows:

Process Sequence

Step 1: introduce a metal salt electrolyte into said apparatus, wherein the metal salt electrolyte contains at least one cationic form of the following metals: Cu, Au, Ag, Pt, Ni, Sn, Co, Pd, Zn.

Step 2: transfer a substrate to one side of substrate holder or two substrates to both sides of substrate holder with electrical conduction path to substrate conductive layer that is to be exposed to the electrolyte, the substrate holder is electricity conducting;

Step 3: apply a small bias voltage up to 10V to substrate;

Step 4: bring substrates into electrolyte, and the front surfaces of the substrates are in full contact with the electrolyte;

Step 5: apply electrical current to each electrode; the power supplies connected to electrodes switch from voltage mode to current mode at desired times;

Step 6: maintain constant electrical current on electrode with the electrical current range from 0.1 A to 100 A and turn on ultra/mega sonic device; the power intensity of ultra/mega sonic device is in the range of 0.01 to 3 W/cm$^2$; the frequency of ultra/mega sonic device is set between 20 KHz to 10 MHz; in another embodiment, the applying electrical current is operable pulse reverse mode with pulse period from 5 ms to 2 s;

Step 7: oscillating substrate passing through entire acoustic zone B with different power intensity, from zone B to zone A then back to zone B, from zone B to zone C then back to zone B; the substrate holder oscillation amplitude range is from 1 mm to 300 mm and its frequency is 0.001 to 0.5 Hz; meanwhile, periodically changing the distance of space between the surfaces of ultra/mega sonic device and reflection plate; changing length of the distance of space between the ultra/mega sonic and reflection plate equals to $$N \cdot \frac{\lambda}{2},$$

where λ is the wavelength of the ultra/mega sonic wave and N is a integer number from 1 to 10, and changing frequency is in range of 1 to 10 HZ;

Step 8: turn off ultra/mega sonic device and oscillation of the substrate holder and periodically changing of said space distance;

Step 9: switch power supply to a small bias voltage mode from 0.1V to 0.5V, and apply it on the substrate;

Step 10: bring the substrate out of the electrolyte;

Step 11: stop power supply and clean off the residue electrolyte on a surface of the substrate.

The above method is applied for metallization in the deep cavities on the substrate with dimensions of 0.5 to 50 μm in width and 5 to 500 μm in depth.

In another embodiment of step 7, the amplitude of the substrate oscillation up and down equals to $$\frac{N \cdot \frac{\lambda}{4}}{\sin\theta}, N = 1, 2, 3 \ldots$$

where λ is the wavelength of the ultra/mega sonic wave and N is integers, θ is the angle of ultra/mega sonic device to the bath side wall.

In step 7, the frequency of the space distance periodically changing is larger than the frequency of the substrate oscillation. According to the motions of substrate oscillating and space distance periodically changing, each point of the substrate passing through the area of different power intensity within the space between ultra/mega sonic device and reflection plate, so that the sonic energy dose on substrate is uniform over the course of process.

In another embodiment, the substrate is oscillated horizontally along the wave propagating direction while it oscillating vertically passing through the acoustic area with different power intensity in step 7. The amplitude is controlled as integral times of a quarter wave length of ultra/mega sonic wave.

In another embodiment, the substrate flips at 180 degree while it oscillating in step 7.

In another embodiment, the substrate oscillating up and down with an angle θ, in range of 0 to 45, tilted to the ultra/mega sonic device and its reflection plate in step 7. And the amplitude of the oscillation equals to $$\frac{N \cdot \frac{\lambda}{4}}{\sin\theta}, N = 1, 2, 3 \ldots$$

where λ is the wavelength of the ultra/mega sonic wave and N is integers.

In another embodiment, the substrate rotates with the speed in range of 10 rpm to 300 rpm while the substrate oscillating up and down in step 7.

Another method applied to the metallization apparatus with an ultra/mega sonic device, metallization of substrate from an electroless electrolyte in particular, can be set as follows:

Process Sequence

Step 1: flowing metal salt electrolyte into an immersion bath, wherein the metal is selected from a group of metals consisting of Cu, Au, Ag, Pt, Ni, Sn, Co, Pd, Zn;

Step 2: transferring at least one substrate to a substrate holder;

Step 3: turning on ultra/mega sonic device; the power intensity of the ultra/mega sonic device is in the range of 0.01 to 3 W/cm$^2$; the frequency of the ultra/mega sonic device is set between 20 KHz to 10 MHz;

Step 4: oscillating the substrate holder passing through entire acoustic zone B with different power intensity, from zone B to zone A then back to zone B, from zone B to zone C then back to zone B; the substrate holder oscillation amplitude range is from 1 mm to 300 mm and its frequency is 0.001 to 0.5 Hz;

Step 5: stopping applying the ultra/mega sonic and stopping oscillation of the substrate holder;

Step 6: bringing the substrate out of the metal salt electrolyte.

Another method applied to the metallization apparatus with an ultra/mega sonic device, metallization of substrate from an electroless electrolyte in particular, can be set as follows:

Process Sequence

Step 1: flowing metal salt electrolyte into an immersion bath, wherein the metal is selected from a group of metals consisting of Cu, Au, Ag, Pt, Ni, Sn, Co, Pd, Zn;

Step 2: transferring at least one substrate to a substrate holder;

Step 3: turning on ultra/mega sonic device; the power intensity of the ultra/mega sonic device is in the range of 0.01 to 3 W/cm$^2$; the frequency of ultra/mega sonic device is set between 20 KHz to 10 MHz;

Step 4: oscillating the substrate holder passing through entire acoustic zone B with different power intensity, from zone B to zone A then back to zone B, from zone B to zone C then back to zone B; the substrate holder oscillation amplitude range is from 1 mm to 300 mm and its frequency is 0.001 to 0.5 Hz; meanwhile, periodically changing the distance of space between the surfaces of ultra/mega sonic device and reflection plate; changing length of the distance of space between the ultra/mega sonic device and reflection plate equals to $$N \cdot \frac{\lambda}{2},$$

where λ is the wavelength of the ultra/mega sonic wave and N is a integer number from 1 to 10, and changing frequency is in range of 1 to 10 HZ;

Step 5: stopping applying the ultra/mega sonic and stopping oscillation of the substrate holder and periodically changing of said space distance;

Step 6: bringing the substrate out of the metal salt electrolyte.

Although the present invention has been described with respect to certain embodiments, examples, and applications, it will be apparent to those skilled in the art that various modifications and changes may be made without departing from the invention.

What is claimed is:

1. A method for substrate metallization from electrolyte comprising:

flowing metal salt electrolyte into an immersion bath;

transferring at least one substrate to a substrate holder that is electrically in contact with a conductive side of the substrate;

applying a first bias voltage to the substrate;

applying an electrical current to electrode;

turning on an ultra or mega sonic device;

oscillating the substrate holder along its axis for making the substrate holder pass through the entire acoustic area;

periodically changing the distance of space between the surface of the sonic device and a reflection plate opposite to the surface of the sonic device, wherein the distance of space between the surfaces of sonic device and reflection plate changes periodically with an amplitude equal to N times half wave length of ultra or mega sonic wave, and N is an integer number from 1 to 10;

stopping applying the ultra or mega sonic and stopping oscillation of the substrate holder and periodically changing of said space distance;

applying a second bias voltage to the substrate; and bringing the substrate out of the metal salt electrolyte.

2. The method of claim 1, wherein the first bias voltage is 0.1V to 10V;

the electrical current is 0.1 A to 100 A;

the ultra or mega sonic device has an operating frequency of 20 KHz to 10 MHz and a power intensity of 0.01 to 3 $W/cm^2$;

the substrate holder oscillates with an amplitude of 1 mm to 300 mm and a frequency of 0.001 to 0.5 Hz;

the distance of space between the surfaces of the ultra or mega sonic device and reflection plate changes periodically with a frequency of 1 to 10 HZ;

the second bias voltage is 0.1V to 5V.

3. The method of claim 1, wherein the metal salt electrolyte contains at least one cationic form of the following metals: Cu, Au, Ag, Pt, Ni, Sn, Co, Pd, Zn.

4. The method of claim 1, wherein the deep cavities on the substrate have dimensions of 0.5 to 50 μm in width and 5 to 500 μm in depth.

5. The method of claim 1, wherein the electrical current is applied in DC mode or pulse reverse mode with a pulse period of 5 ms to 2 s.

6. The method of claim 1, wherein the substrate flips at 180 degree while the substrate is within non-acoustic areas.

7. The method of claim 1, wherein each point of the substrate passes through the entire acoustic area and the power intensity on each point of the substrate is uniform over the course of process.

8. The method of claim 1, wherein two substrates are processed in the immersion bath at same time.

9. The method of claim 1, wherein the amplitude of the substrate oscillation equals to $$\frac{N \cdot \frac{\lambda}{4}}{\sin\theta}, N = 1, 2, 3 \ldots$$

here λ is the wavelength of the ultra or mega sonic wave and N is integers, θ is the angle of the sonic device to the side wall of the immersion bath.

10. The method of claim 1, wherein the frequency of the space distance changing periodically is larger than the frequency of substrate oscillation.

11. The method of claim 1, wherein the substrate is oscillated horizontally along the propagating direction of the standing wave while the substrate is oscillated vertically passing through the acoustic area.

12. The method of claim 1, wherein the amplitude of the horizontal oscillation is controlled as integral times of a quarter wave length of ultra or mega sonic wave.

13. The method of claim 1, wherein the substrate oscillates up and down with an angle θ in range of 0 to 45 degree, tilted to the sonic device and the reflection plate, and the amplitude of the oscillation equals to $$\frac{N \cdot \frac{\lambda}{4}}{\sin\theta}, N = 1, 2, 3 \ldots$$

where λ is the wavelength of the ultra/mega sonic wave and N is integers.

14. The method of claim 1, wherein the substrate rotates with the speed in range of 10 rpm to 300 rpm while the substrate oscillating up and down.

* * * * *